US005947817A

United States Patent [19]

Morris et al.

[11] Patent Number: 5,947,817

[45] Date of Patent: Sep. 7, 1999

[54] ROLLABLE ROOF VENTILATING DEVICE AND METHODS FOR USE THEREOF

[75] Inventors: Richard J. Morris, Prior Lake; Michael L. Gosz, Minneapolis; Mark S. Stoll, Deephaven, all of Minn.

[73] Assignee: Diversi-Plast Products, Inc., Golden Valley, Minn.

[21] Appl. No.: 09/002,538

[22] Filed: Jan. 2, 1998

Related U.S. Application Data

[63] Continuation-in-part of application No. 08/828,257, Mar. 26, 1997, which is a continuation-in-part of application No. 08/570,656, Dec. 11, 1995, Pat. No. 5,651,734.

[51] Int. Cl.[6] ..... F24F 7/00

[52] U.S. Cl. ..... 454/365; 52/199

[58] Field of Search ..... 454/365; 52/57, 52/199

[56] References Cited

U.S. PATENT DOCUMENTS

| | | | |
|---|---|---|---|
| D. 257,282 | 10/1980 | Roberts | D23/153 |
| D. 257,283 | 10/1980 | Roberts | D23/153 |
| 3,185,070 | 5/1965 | Smith . | |
| 3,889,892 | 6/1975 | Mclead | 242/527.3 |
| 3,949,657 | 4/1976 | Sells . | |
| 4,803,813 | 2/1989 | Fitermann | 52/199 |
| 4,807,409 | 2/1989 | Sells | 52/95 |
| 4,843,953 | 7/1989 | Sells . | |
| 4,942,699 | 7/1990 | Spinelli | 52/57 |
| 5,054,254 | 10/1991 | Sells | 52/199 |
| 5,092,225 | 3/1992 | Sells | 454/365 |
| 5,094,041 | 3/1992 | Kasner et al. | 52/57 |
| 5,099,627 | 3/1992 | Coulton et al. | 52/408 |
| 5,304,095 | 4/1994 | Morris | 454/365 |
| 5,328,407 | 7/1994 | Sells | 454/365 |
| 5,331,783 | 7/1994 | Kasner et al. | 454/365 X |
| 5,427,571 | 6/1995 | Sells | 454/365 |
| 5,439,417 | 8/1995 | Sells | 454/365 |
| 5,542,882 | 8/1996 | Sells | 454/365 |
| 5,602,657 | 2/1997 | Sells | 454/359 |
| 5,673,521 | 10/1997 | Coulton et al. | 454/365 X |

*Primary Examiner*—Harold Joyce
*Attorney, Agent, or Firm*—Patterson & Keough, P.A.

[57] ABSTRACT

A ventilating system for a roof made of a multi-plied weatherproof material. The weatherproof material includes a planar ply and a second ply joined such that a multiplicity of air passages is defined thereby. The air passages extend generally transversely to longitudinal axes of the embodiments. Each embodiment can be transported and stored in a spiral conformation. The spiral conformation is achieved by rolling the embodiment in a direction generally parallel to the longitudinal axis. A series of embodiments include a top panel and one or more lateral vents, rolled such that the one or more lateral vents are radially exposed. When shipped and stored in a spiral conformation, the embodiment with radially exposed lateral vents is more quickly and easily installed on a roof. Another embodiment, also conformable to a spiral for shipping and storing, is advantageously used to enhance ventilation by ventilating the eave.

94 Claims, 12 Drawing Sheets

ROLLABLE ROOF VENTILATING DEVICE AND METHODS FOR USE THEREOF

CROSS-REFERENCES TO RELATED APPLICATIONS

This is a continuation-in-part of U.S. application Ser. No. 08/828,257, filed 26 Mar., 1997, which is a continuation-in-part of U.S. application Ser. No. 08/570,656, filed 11 Dec., 1995, now U.S. Pat. No. 5,651,734.

FIELD OF THE INVENTION

The present invention relates to roof ventilating devices and, in particular, the present invention relates to roof ventilating devices made of corrugated materials which may be conformed to a spiral for shipment and storage.

BACKGROUND OF THE INVENTION

Insufficient roof ventilation can result in a prolonged interface between still moist air and a colder surface. Moisture condensation on the colder surface occurs when these conditions are present. The condensed moisture often spots and damages ceilings. In more severe cases structural members such as joists and studs are continually damp and become unsound. Buildings with insufficiently ventilated roofs also tend to be warmer in summer months due to the presence of solar-heated air trapped within. These buildings are more expensive to maintain at comfortable temperatures than if the roofs thereof were adequately ventilated. When adequate ventilation occurs, air is kept in motion by being circulated from the outside the roof, through the attic and out through vents often placed near the ridge. This ventilation is necessary in order to prevent accumulation of hot air or condensed moisture. Various products have been developed to provide forms of ventilation. These products either provide separate ventilation structures or are themselves building materials with ventilating properties.

One particular type of design calls for a gap or slot to be cut into the decking at or proximate the peak of a roof. A ventilated cover is disposed over the gap and is attached to the roof along each side of its peak. Ventilation is provided by air passages within the ventilated cover which extends downwardly from the peak toward the eaves. U.S. Pat. No. 4,803,813 to Fiterman and U.S. Pat. Nos. 5,094,041 and 5,331,783 to Kasner et al., describe various methods of scoring, folding, and routing blanks of corrugated plastic sheet material to form foldable roof vents, as well as methods for installation and use of these vents. These folded roof ventilators were traditionally made and sold in lengths of approximately four feet. A hinged double-length roof vent, disclosed in U.S. Pat. No. 5,304,095 to Morris, enhanced the shipping and installation of such roof vents.

Other types of roof covering products such as shingles, tar paper, and some roof ventilation products fabricated from woven fiber or other materials are distributed in rolled form. Distribution in rolled form permits longer lengths of the products to be shipped and installed. Moreover, installation of these rolled products eliminates or reduces some potentially undesirable features such as frequent seams and gaps.

U.S. Pat. No. 5,651,734 discloses a multi-layer ridge cap roof ventilator. The ventilator is fabricated from double-faced corrugated plastic sheet material and includes two opposing vents. After fabrication, the plastic sheet material is rolled into a spiral configuration, then secured in the spiral by bands for shipping. Upon arrival at an installation site, the roll is transported to the roof, unrolled, and the scored panels are sequentially folded to form the opposing vent parts. The finished ventilator is then secured to the roof.

Those skilled in the art will appreciate that it has heretofore been required to select between the advantages of assembled multi-layered corrugated plastic roof ventilators which cannot be rolled and rolled roofing products which also fail to provide the advantages of a multi-layered corrugated plastic product. Moreover, the former choice often requires additional steps to be taken during installation to convert a rolled and scored blank of double-faced corrugated plastic sheet material into an assembled multi-layer roof ventilator.

Those skilled in the art will appreciate yet other improved features in roof vents made of corrugated materials. These products offer economic and efficient features such as more efficient shipping, handling and storage. These products also offer enhanced features which reduce the time and effort necessary for installation.

SUMMARY OF THE INVENTION

There is provided a roof venting device which includes a first vent. The first vent includes a first panel made from a weatherproof material. The weatherproof material includes a first and second ply joined such that a multiplicity of first air passages is defined thereby. The weatherproof material may include a planar ply and a convoluted ply. An alternate weatherproof material includes two planar plies and a convoluted ply. Each planar ply is joined to the convoluted ply such that a multiplicity of air passages is defined thereby. Another alternate weatherproof material includes two planar plies joined by a plurality or multiplicity of cross walls such that a multiplicity of air passages is defined thereby. Internal and external openings are defined in the weatherproof material for at least a portion of the first air passages. The air passages extend generally transversely to a longitudinal axis of the venting device. The first vent is conformable to a spiral by being rolled in a direction generally parallel to the longitudinal axis.

There is also provided a vent in which a plurality of first panels is present and in which the first panels are affixable to each other in a generally underlying relationship.

There is also provided a vent conformable to a place on a roof in which there is a change in the roof slope. The vent includes a top panel made from any of the weatherproof materials. The air passages defined by the weatherproof materials in the top panel are generally parallel to the air passages of the first panel. The vent is also conformable to a spiral. When in a spiral or a roll, a portion of the vent may be radially exterior to an attached portion of the top panel.

There is also provided a venting device which further includes a second vent made of any of the above-described weatherproof materials. The second vent includes a multiplicity of second air passages defined by the weatherproof material. The second air passages extend generally parallel to the first air passages. An upper panel of the second vent is affixable to the top panel in a generally underlying relationship.

There is also provided an end cap conformable to an underside of the top panels of the vents described herein. The end cap is further conformable to a portion of the roof underlying the top panel. The end cap prevents ingress of precipitation when in place.

There is also provided an air deflector which includes first and second planar portions. The first planar portion is disposable beneath a panel of the vents described herein. When so disposed, the air deflector diverts ambient air flow and thereby inhibits ingress of precipitation into air passages proximate the second planar portion of the air deflector.

There is also provided a ridge vent for placement on a roof. The ridge vent includes a top panel and vent means. The top panel defines a longitudinal axis, first and second ends, first and second side edges and an inner and an outer surface. The vent means are attached to a corresponding portion of an inner surface of the top panel. The vent means includes a multiplicity of air passages. The vent means define an interior opening and an exterior opening for at least a portion of the air passages. The ridge vent is assembled to form a first rolled conformation for shipment and a second unrolled conformation for placement or installation on a roof. In the first rolled conformation, the vent means protrudes a greater radial distance from a center of the rolled ridge vent than any top panel attached to the corresponding vent means.

There is also provided a method of making a device for ventilating a roof. The method includes the steps of providing any of the above-described weatherproof materials which define a multiplicity of air passages; defining a first panel in the provided weatherproof material such that the air passages extend generally transversely to a longitudinal axis of the first panel; defining interior openings in at least a portion of the multiplicity of first air passages; and conforming the first panel into a spiral by rolling the first panel in a direction generally parallel to the first panel longitudinal axis.

There is also provided another method of making a device for ventilating a roof. The method includes the steps of providing any of the above-described weatherproof materials which define a multiplicity of air passages; defining first and second panels in the weatherproof material such that the air passages in the first and second panels extend generally transversely to the longitudinal axis of the first panel; disposing the first and second panels in a generally underlying relationship; and conforming the first and second panels into a spiral by rolling the first and second panels in a direction generally parallel to the first panel longitudinal axis. The method may include conforming the first and second panels such that the first panel is a first radial distance from the center of the spiral, the second panel is a second radial distance from the center of the spiral and the first radial distance is less than the second radial distance.

There is also provided a method of installing a venting device on a roof with a slot defined by a sheathing layer. The method includes the steps of providing a vent assembly, the vent assembly including a first panel made from any of the weatherproof materials described herein, the weatherproof materials extending generally transversely to a longitudinal axis of the first panel, the vent assembly conformed into a spiral by rolling the first panel in a direction generally parallel to the first panel longitudinal axis; unrolling the vent assembly; and disposing or affixing the unrolled vent assembly to the roof.

The method of installing a venting device may also include providing a vent assembly with a first and a second panel, the second panel proximate the first panel in a generally underlying relationship, the first and second panel conformed into a spiral in which the second panel is radially exposed in the spiral and further including the step of disposing the second vent proximate the slot.

The method of installing a venting device may also include providing a vent with a first, a second, and a third panel, the second panel opposing the third panel, the second and third panels proximate the first panel in a generally underlying relationship, the first, second and third panels conformed into a spiral, the second and third panels being radially exposed in the spiral.

There is also provided a method of installing a venting device in an eave of a roof. The method includes the steps of providing the venting device, the venting device made of any of the weatherproof materials herein described and with a multiplicity of air passages extending generally transversely to a longitudinal axis of the venting device, the venting device conformable to a spiral by rolling the venting device in a direction generally parallel to the longitudinal axis; and affixing the venting device proximate the eave.

Another method or process of forming a vent for a roof is provided. The vent is formed from a weatherproof material with a fluted layer disposed between first and second generally planar layers such that a multiplicity of generally parallel air passes is formed thereby. The process includes the steps of providing a sheet of the weatherproof material; forming a pair of first lateral slits, a sheet longitudinal axis generally disposed between the first lateral slits, each first lateral slit extending through the second planar layer and at least partially through the fluted layer, thereby defining a top panel and two laterally disposed side panels; folding each side panel in an underlying relationship to the top panel by automatic or manual folding means; securing each side panel to the top panel by automated or manual securing means, thereby forming a vent; and conforming the vent into a spiral configuration by rolling the vent along the longitudinal axis.

DETAILED DESCRIPTION OF THE DRAWINGS

This is a continuation-in-part of U.S. application Ser. No. 08/828,257, filed 26 Mar., 1997. U.S. application Ser. No. 08/828,257, in turn, is a continuation-in-part of U.S. Pat. No. 5,651,734. Roof vents are described in U.S. Pat. Nos. 4,803,813; 5,094,041; 5,304,095; and 5,331,783. A wind deflector and an end cap are respectively described in U.S. application Ser. Nos. 08/127,005 and 08/126,307, both applications filed 24 Sep., 1993. All above-enumerated U.S. patents and applications are assigned to the present assignee and are hereby incorporated by reference into this specification as fully recited herein, including but not limited to their disclosures.

Figure 1:
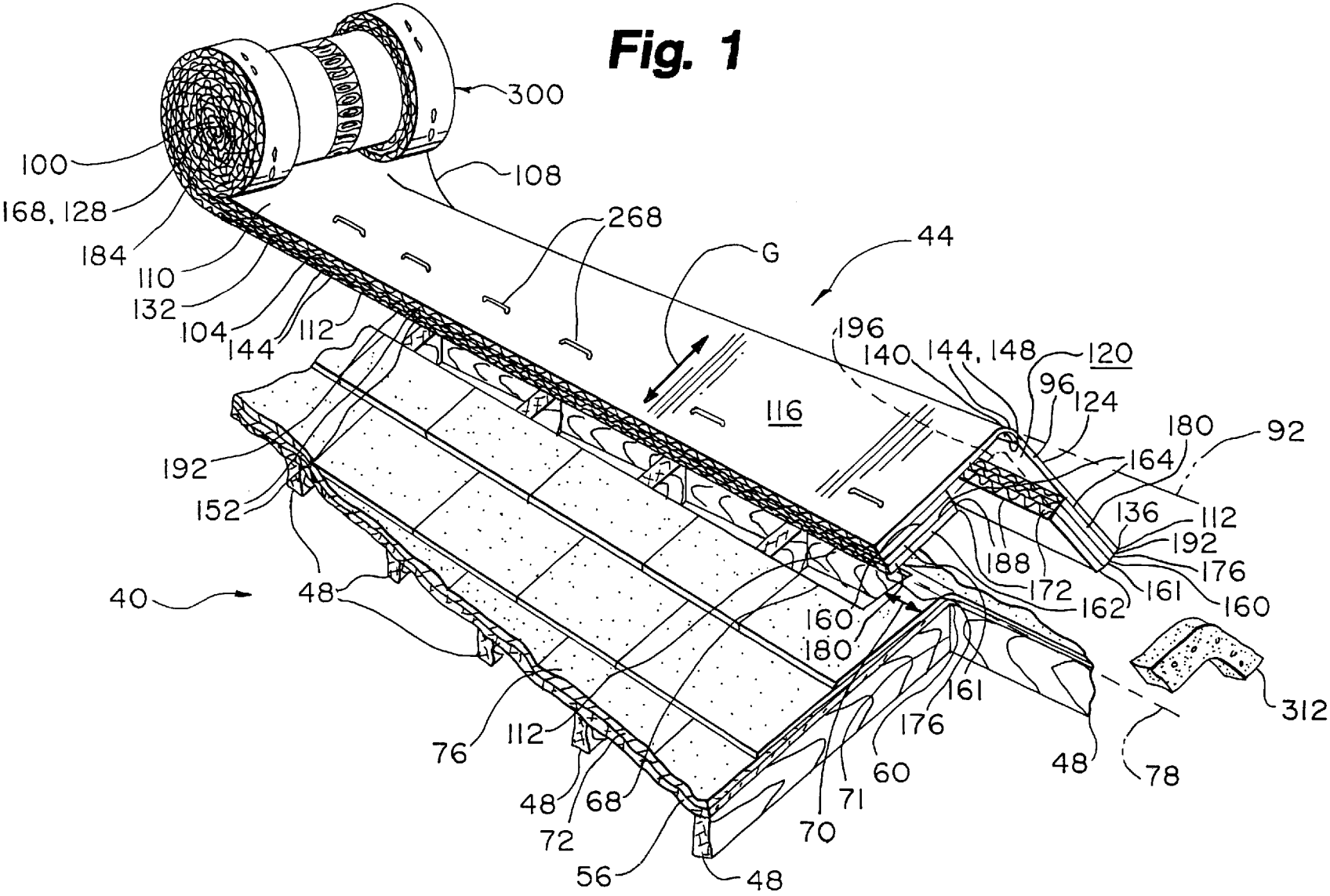
FIG. 1 is a fragmentary elevated perspective view of a ridge vent of the present invention being installed on a roof.

In FIG. 1, an upper fragmentary cross section of roof 40 is depicted. Exemplary roof ventilator 44 is being installed on roof 40. Roof 40, in this example, is a truss roof. However, those skilled in the art will appreciate that other roof forms may be ventilated by installing the present invention. Exemplary roof 40 includes upper chords 48 and sheathing or decking 56. The ridge or apex 60 of roof 40 is formed proximate opposing upper chords 48, which meet at ridge 60. Upper chords 48 will be rafters joined to ridge board 52 (FIG. 22) at ridge 60 if roof 40 is a rafter roof. Sheathing or decking 56 usually consists of plywood sheets or planking members (not shown) overlaying and affixed to upper chords 48. Cutouts 68 are present in decking 56. A cutout 68 is disposed on each side of ridge 60, beginning a distance 70 from gable end 71 of roof 40 in this example. Overlaying sheathing 56 is a layer of felt paper 72. Exterior roofing 76, such as asphalt shingles, overlays felt paper 72. Ridge 60 generally extends along ridge longitudinal axis 78.

Ridge vent 44, as shown in FIG. 1, extends generally along longitudinal axis (or longitudinal centerline) 92. Present on ridge vent 44 are first end 96, second end 100, first lateral edge 104, and second lateral edge 108. Vent 44 broadly includes top panel 110. One or more lateral vents 112 may also be present. In this embodiment, top panel 110 defines upper surface 116, lower surface 120, first end 124, second end 128, first lateral edge 132, and second lateral edge 136. On lower surface 120, route 140 is optionally provided. Route 140 coextends with longitudinal axis 92 in this embodiment. However, other orientations for route 140 may be present. Present within top panel 110 is a multiplicity of air passages 144. Air passages 144 generally extend from route 140 to each lateral edge 132, 136 on top panel 110.

Air passages 144 extend generally transversely (for example, perpendicularly) to longitudinal axis 92. Each air passage 144 terminates in an interior opening 148 and an exterior opening 152. Interior openings 148 are defined by route 140. Exterior openings 152 are defined by each of lateral edges 132, 136. Air passages 144 are more fully described hereinbelow.

Each exemplary lateral vent 112 includes at least one of vent panels 160–162. In FIGS. 1, 2, 5, 12, 21 each lateral vent 112 includes three or more vent panels 160–162. However, any number of vent panels may make up lateral vent 112 and be within the spirit and scope of this invention. Generally, lateral vents 112 include first end 164, second end 168, interior edge 172, and exterior edge 176. Dimensionally corresponding to lateral vents 112 in this embodiment, each vent panel 160–162 includes first end 180, second end 184, interior edge 188, and exterior edge 192. Also present in each vent panel 160–162, therefore present within each lateral vent 112, is a plurality of air passages 144. Air passages 144 are defined in the same fashion as above-described with respect to top panel 110. In this embodiment, exterior edges 192 of vent panels 160–162 generally co-align with first and second lateral edges 132, 136 of top panel 110. A gap 196 is defined between interior edges 188 of the vent panels of opposing lateral vents 112. Gap 196 thereby exposes lower surface 120 of top panel 110 and interior edges 172 of lateral vents 112. First and second ends 180, 184 of vent panels 160–162 of lateral vents 112 may coincide with first and second ends 124, 128 of top panel 110.

Figure 11:
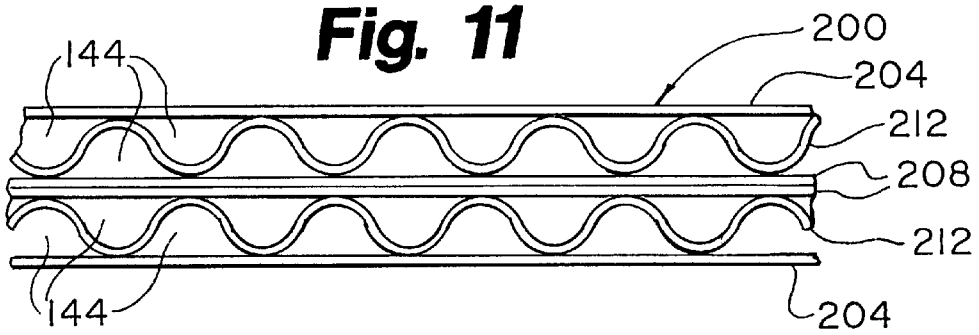
FIG. 11 is a fragmentary side plan view of the three-ply weatherproof material used to fabricate the venting devices of the present invention.

Exemplary top panel 110 and vent panels 160–162 may be made from a three-ply weatherproof material 200. As seen in FIG. 11, material 200 broadly includes first planar ply 204, second planar ply 208, and convoluted (or fluted) ply 212. Plies 204, 208, 212 are joined together such that air passages 144 are defined therebetween.

Figure 9:
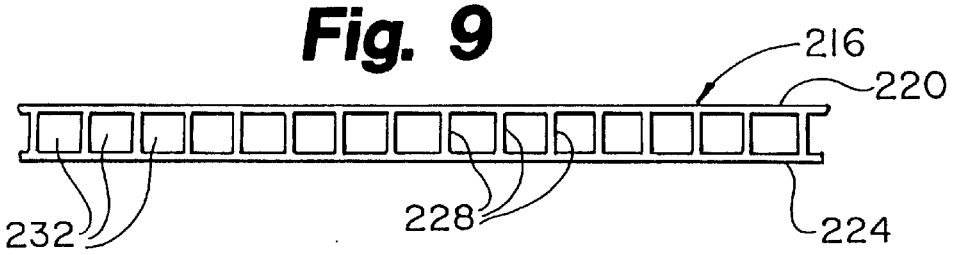
FIG. 9 is a fragmentary side plan view of an alternate embodiment of the three-ply weatherproof material of FIG. 11.

An alternative three-ply weatherproof material 216 is depicted in FIG. 9. Weatherproof material 216 includes first planar ply 220, second planar ply 224, and a series or multiplicity of cross walls 228. Cross walls 228 extend generally transversely (for example, perpendicularly) between planar plies 220, 224. Planar plies 220, 224 and cross walls 228 are joined such that a multiplicity of air passages 232 is defined therebetween.

Figure 10:
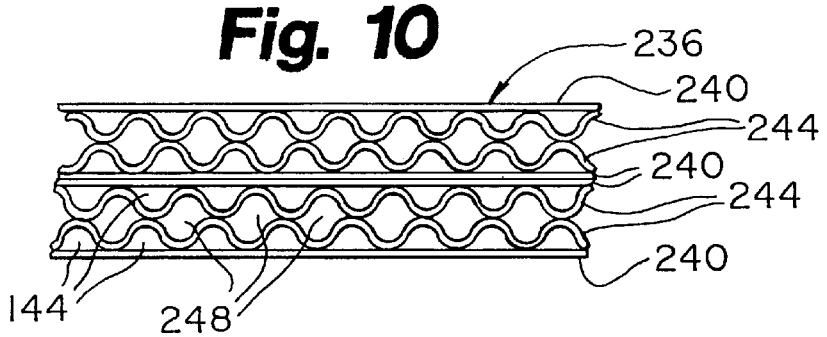
FIG. 10 is a fragmentary side plan view of an embodiment of a two-ply weatherproof material used in the present invention.

FIG. 10 depicts a two-ply material 236 as still another alternate embodiment of the weatherproof material. Two-ply material 236 includes planar ply 240 and convoluted ply 244. Planar ply 240 and convoluted ply 244 are joined together such that another multiplicity of air passages 144 is defined therebetween. Moreover, when two or more layers of two-ply material 236 are folded such that convoluted plies 244 generally face and contact each other, another multiplicity of air passages 248 is formed therebetween.

Weatherproof materials 200, 216, and 236 may be formed from a high density polyethylene or other synthetic resin. However, weatherproof materials 200, 216, and 236 may also be formed from corrugated paperboard coated with a sealant such as an epoxy to protect the paperboard from deterioration due to moisture and similar elements. In addition to being impervious to moisture, suitable materials should also resist deterioration from exposure to solar radiation and heat. Such corrugated polyethylenes may be obtained from U.S. Corrulite, Inc., South Bay, Fla. (or Winona, Miss.), Diversi-Plast Products, Inc., Golden Valley, Minn., and Fremont Direct Products, Inc., Fremont, Ohio.

Figure 4:
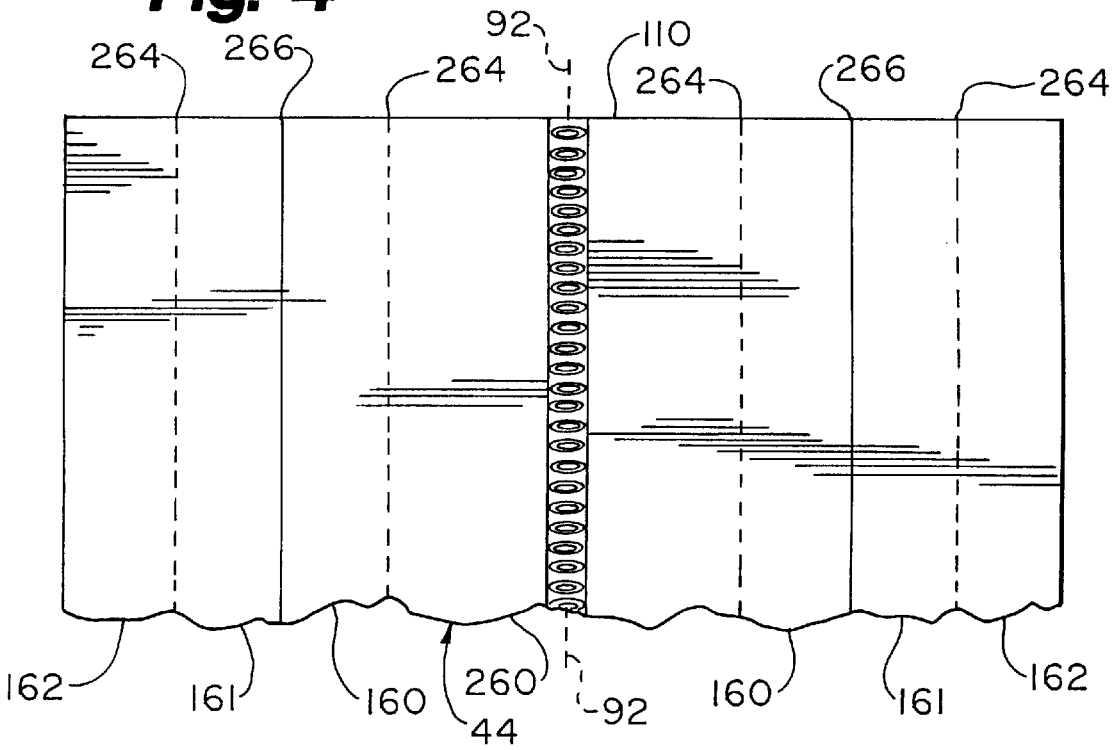
FIG. 4 is a fragmentary bottom plan view of a sheet of weatherproof material, depicting a center route and cut score lines which define the top panel and vent panels of the ridge vent of FIG. 1.
Figure 12:
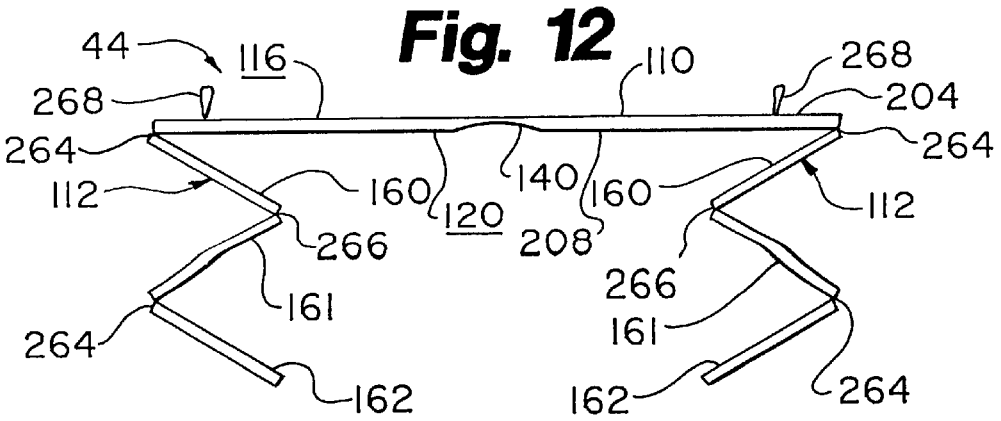
FIG. 12 is an end plan view of the ridge vent of FIG. 1, depicting the hinged panels of the lateral vents.
Figure 28:
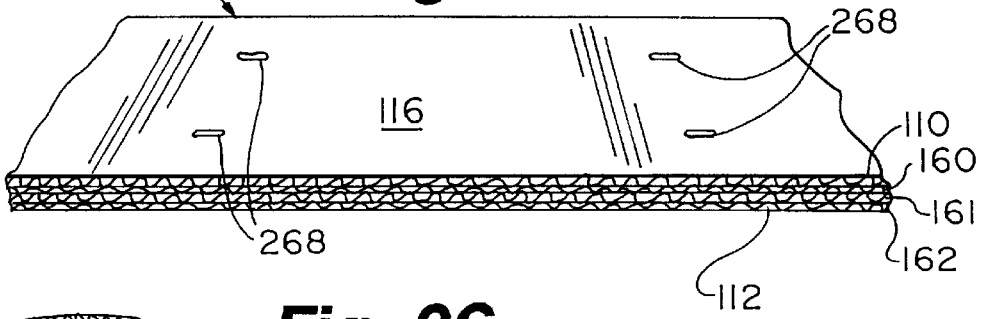
FIG. 28 is an elevated perspective view of the vent of FIG. 23 after being unrolled.
Figure 29:
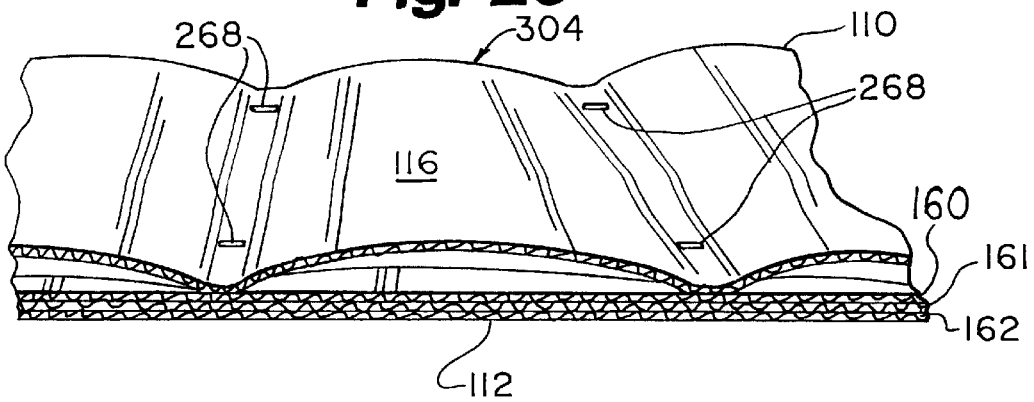
FIG. 29 is an elevated perspective view of the vent of FIG. 24 after being unrolled.

FIG. 4 shows vent 44 to be formed from unitary sheet 260. Sheet 260 is formed from the above-described materials. A series of cut score lines 264, 266 define top panel 110 and vent panels 160–162. Score lines 264, 266 generally extend parallel to longitudinal axis 92. FIG. 12 depicts top panel 110 and first vent panels 160 as being formed by extending slit 264 in first planar ply 204, and extending slit 264 at least partially through convoluted ply 212. Intermediate vent panel 161 is laterally adjacent the first formed vent panel 160. Intermediate vent panel 161 is partially defined along score line 266. Score line 266 is formed by extending a slit through second planar ply 208 and at least partially through convoluted ply 212. Finally, intermediate vent panel 161 and flanking vent panel 162 are defined completely by extending score line 264 as described above. Having thus been defined by score lines 264, 266, panels 160–162 are folded under top panel 110 in a Z-fold technique. Fastening means or fasteners 268, such as staples, are then placed through top panel 110 and each of vent panels 160–162 as shown in FIGS. 28, 29.

Figure 7:
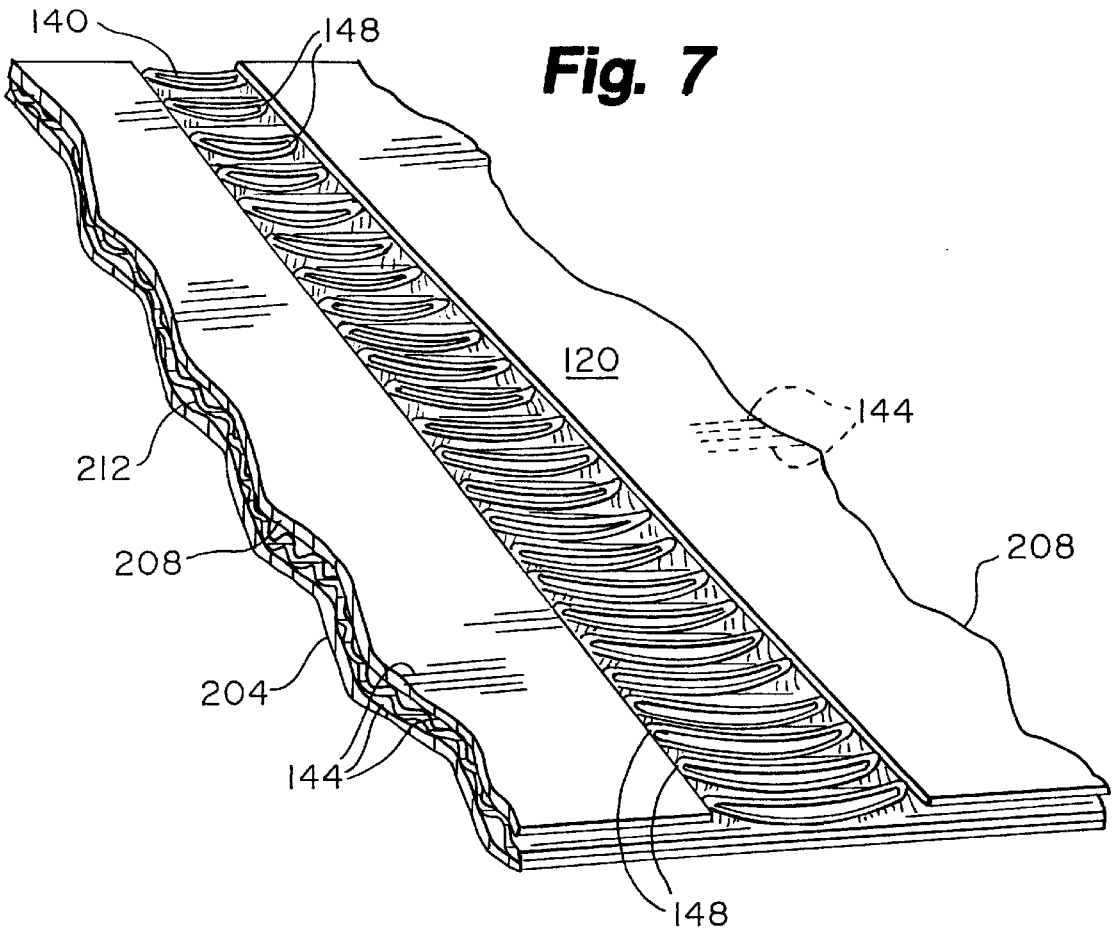
FIG. 7 is a fragmentary top perspective view of the top panel of the ridge vent of FIG. 1 depicting a center route therein.
Figure 8:
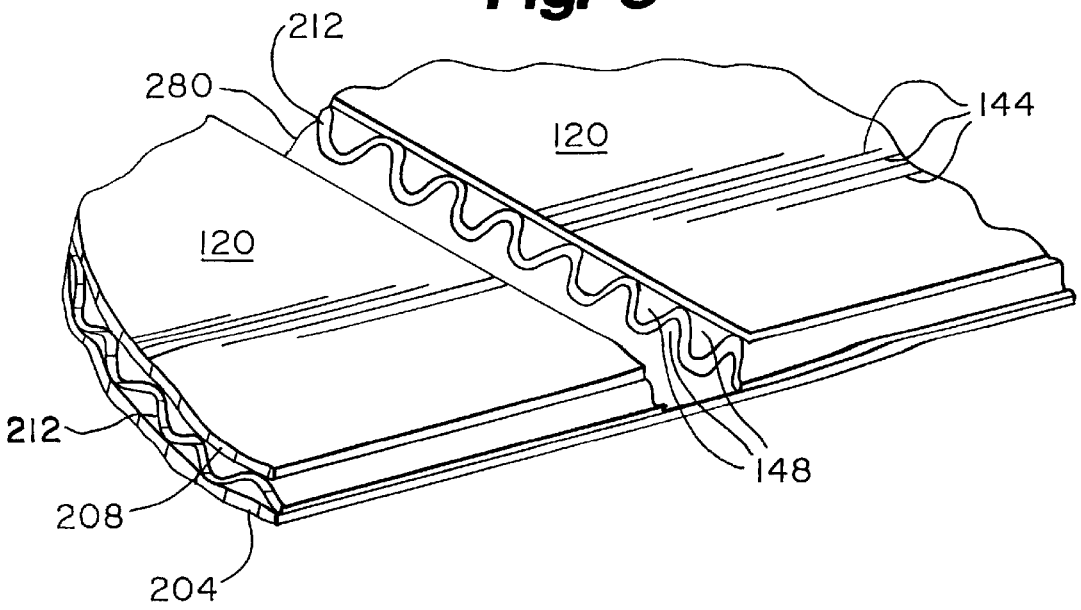
FIG. 8 is a fragmentary top perspective view of a top panel of the ridge vent of FIG. 1 depicting another embodiment of the center route of FIG. 7.

FIG. 1 depicts route 140 as coextending with longitudinal axis 92 in this embodiment. Route 140 is defined on lower surface 120 by removing a generally linear portion of planar ply 208 and an underlying portion of convoluted ply 212. As can be seen in FIG. 7, route 140 is generally arcuate in cross section. However, other cross sectional conformations are possible and still achieve certain of the advantages described herein. One alternative cross sectional geometry is depicted in FIG. 8 as route 280. Route 280 is formed by removing planar ply 208 and underlying portions of convoluted ply 212, leaving planar ply 204 intact. Rather than an arcuate cross section as in route 140, route 280 is generally square or rectangular in cross section. As in the case of route 140, when route 280 is being defined, interior openings 148 for air passages 144 are defined as well. Other alternative cross sectional geometries for the route defined within top panel 110 include a V-notch (not shown). A less desirable definition would be a crease (not shown). If only a crease is present, interior openings 148 would not be defined. Thus, air passages 144 would not be present within top panel 110 in such a way as to allow for ventilation. Thus routes 140, 280 serve to define interior openings 148 of air passages 144. Routes 140, 280 also function to allow vent 44 to be folded easily and precisely generally along longitudinal axis 92 during installation for conformance to the contours of roof 40.

Accordingly, vent 44 may include top panel 110 and opposed lateral vents 112. As shown in FIG. 1, each lateral vent 112 includes at least one vent panel 160. Having been formed from a unitary sheet 260 of weatherproof material in the manner described above, a multiplicity of air passages 144 is present in top panel 110 and each vent panel 160–162. Air passages 144 in top panel 110 and each vent panel 160–162 are generally parallel with respect to each other and are generally transverse to longitudinal axis 92. Moreover, having been appropriately oriented, air passages 144 define a grain G. Grain G thus indicates that air passages 144 extend generally transversely (for example, perpendicularly) to longitudinal axis 92.

Figure 22:
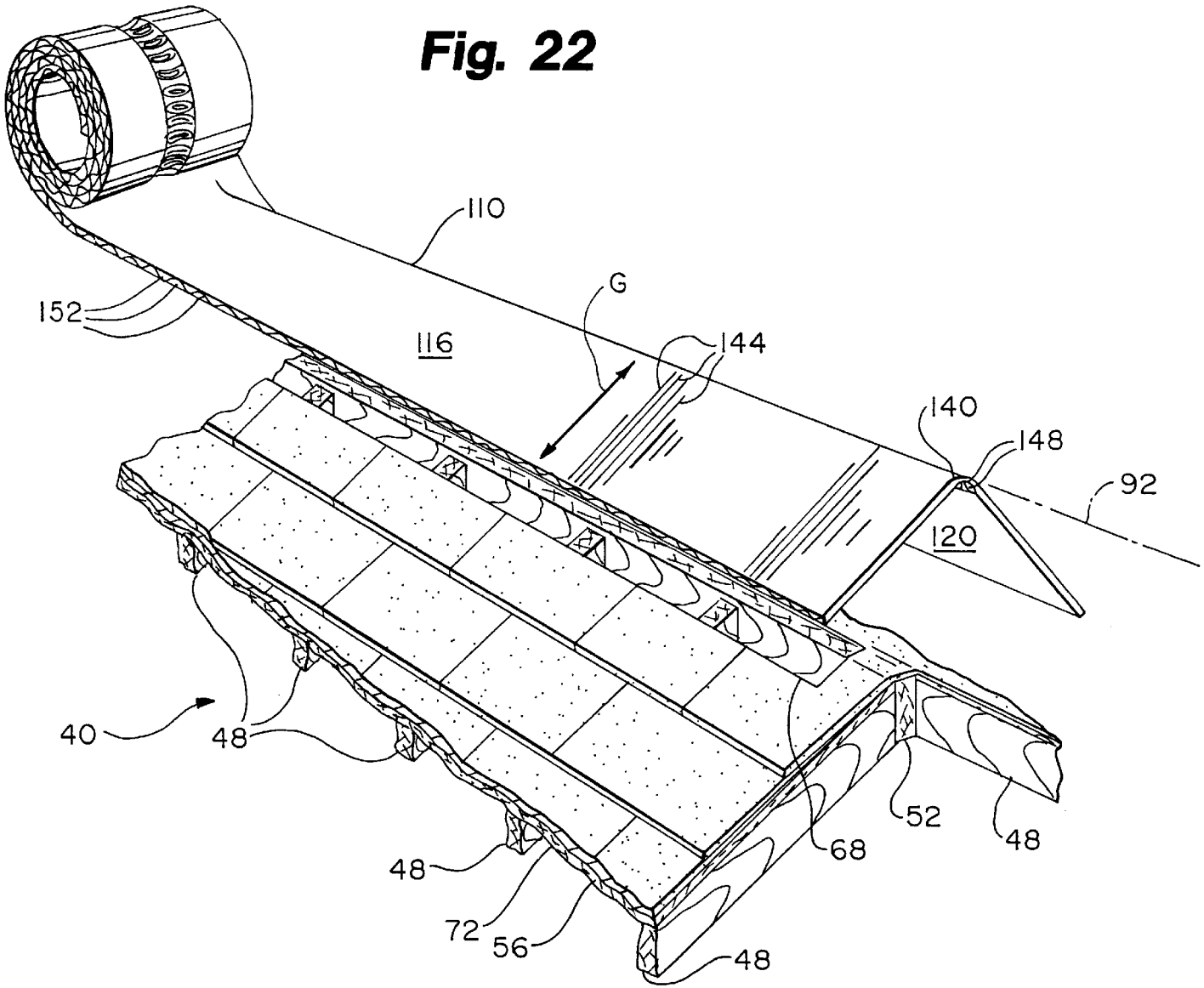
FIG. 22 is an elevated perspective view of the top panel of the vent of FIG. 1 when used singly as a ventilating device.

As shown in FIG. 22, top panel 110 may be used singly as a vent to enable air exchange in some roof designs. Thus, air passages 144 extend generally transversely to longitudinal axis 92. Route 140 or another embodiment thereof is also optionally defined proximate or coextensive longitudinal axis 92 as discussed above. Top panel 110, when used singly, may be formed from a unitary sheet of weatherproof material such that one or more routes 140 define interior openings 148 of air passages 144. Route 140 also enables top panel 110 to be conveniently folded along longitudinal axis 92 and thereby better conform to the opposing contours of roof 40.

Figure 21:
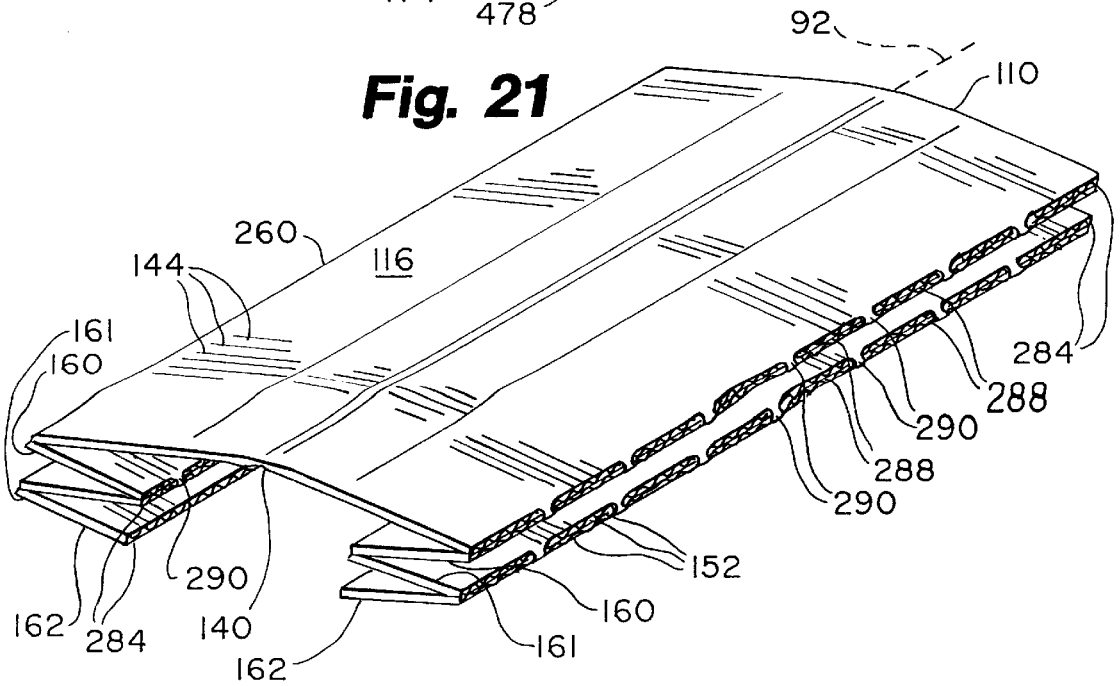
FIG. 21 is an elevated perspective view of an alternate embodiment of the ventilator of FIG. 1 in which panels of both lateral vents are hingedly connected by means of perforations.

FIG. 21 depicts an alternative method of forming top panel 110 and vent panels 160–162 from sheet 260. As in the case with score lines 264, 266, perforated lines 284 extend generally parallel to longitudinal axis 92. However, in contrast to score lines 264, 266, perforated lines 284 are formed by a series of perforations 288 extending through plies 204, 208, 212. Interspersed between perforations 288 are intact areas 290. Perforated lines 284, hence perforations 288, thus define top panel 110 and vent panels 160–162. Perforations 288 further define exterior openings 152 for air passages 144. Once formed, vent panels 160–162 may be Z-folded under top panel 110 as described above and secured together by means of a fastener 268, as described above.

Figure 3:
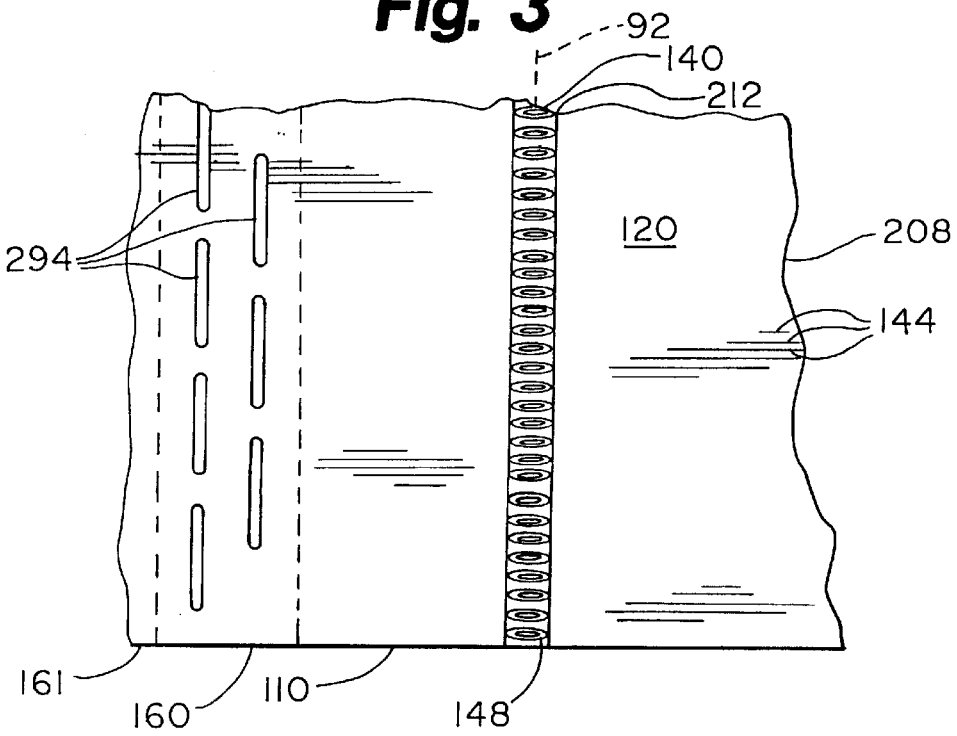
FIG. 3 is a fragmentary bottom plan view of another embodiment of the ridge vent of FIG. 1.

As shown in FIG. 3, a series of elongated slots 294 may be present in vent panels 160–162. Slots 294 may be present in two offsetting rows, each row being generally parallel to longitudinal axis 92. Slots 294 interrupt air passages 144 and thus inhibit moisture ingress into gap 196.

Figure 5:
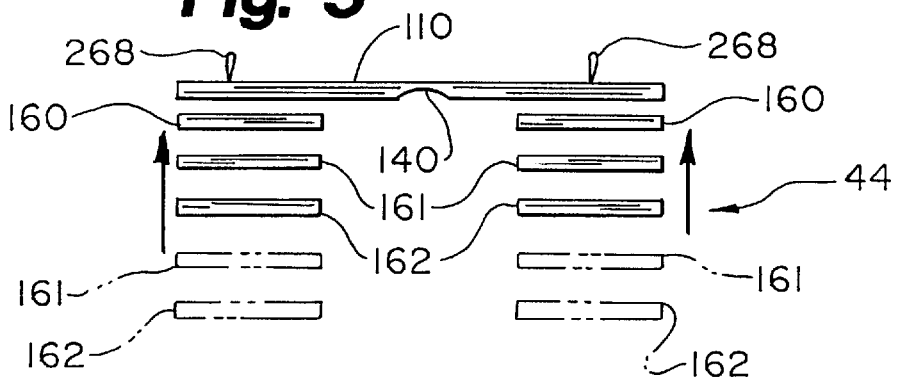
FIG. 5 is an end plan view of another embodiment of a ridge vent, depicting detached vent panels being assembled.
Figure 6:
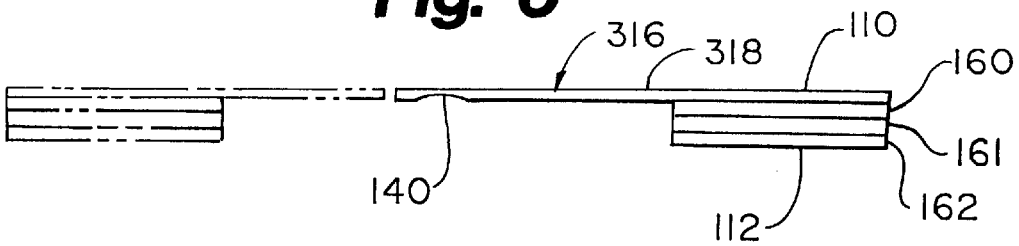
FIG. 6 is an end plan view of the ridge vent of FIG. 1, in which a venting device with a single lateral vent is being constructed therefrom.

Alternatively, top panel 110 and vent panels 160–162 may be defined by completely severing vent panels 160–162 from unitary sheet 260. Once severed, vent panels 160–162 may be stacked beneath top panel 110 and secured thereto by means of fasteners 268 such as staples or equivalent fastening means, as shown in FIG. 5.

Figure 23:
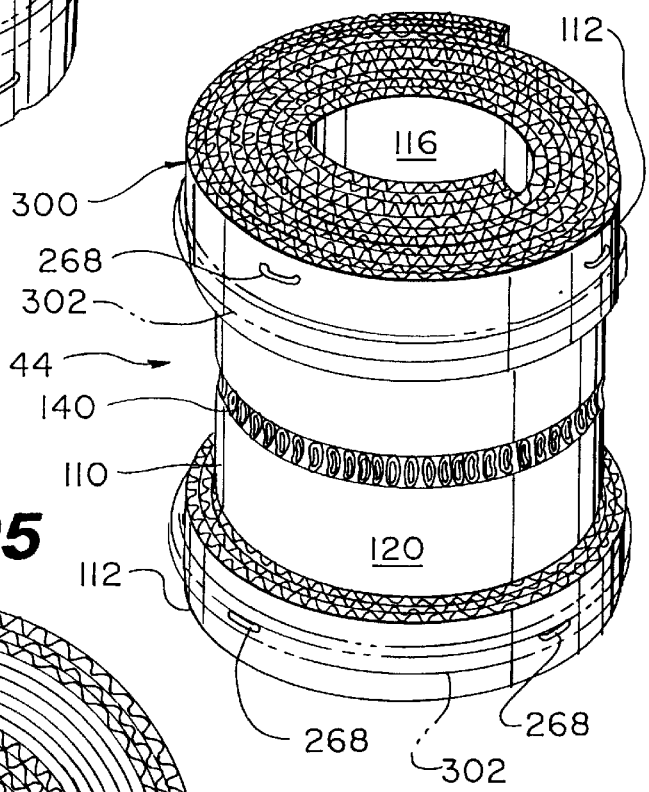
FIG. 23 is an elevated perspective view of the vent of FIG. 1 in a spiral or rolled conformation.

Referring to FIG. 23, roll 300 is formed by rolling assembled vent 44 in a direction generally parallel to longitudinal axis 92 and such that lateral vents 112 are exposed on an exterior portion of the roll, in addition to said portions exposed at the ends of each roll. Once in the desired spiral conformation, roll 300 is secured by band 302, or by similar retaining means.

Rolled vents of the present invention have provided advantages when the rolled vents are shipped, stored, and transported. Moreover, a combination of means for hingably connecting adjacent panels and the relative orientation of top and vent panels in these rolls have produced unexpected benefits, especially when these rolls are installed on roofs.

Figure 24:
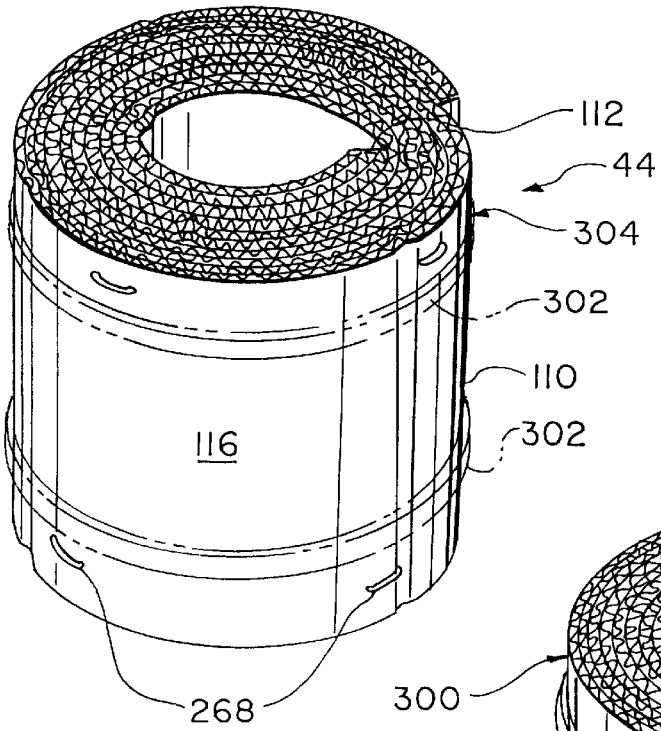
FIG. 24 is an elevated perspective view of the vent of FIG. 1 in an alternate spiral or rolled conformation.
Figure 26:
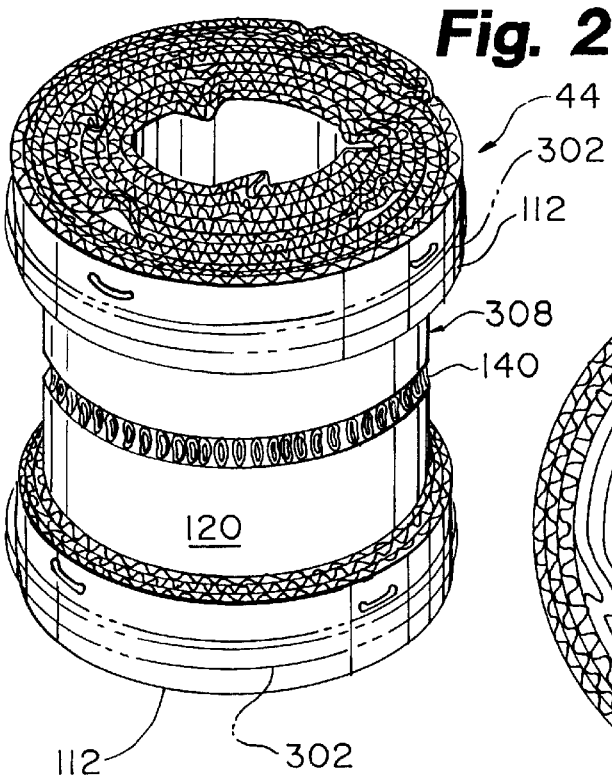
FIG. 26 is an elevated perspective view of a roll of another embodiment of the vent of FIG. 1 in which the panels of the lateral vents are not hingedly connected.
Figure 27:
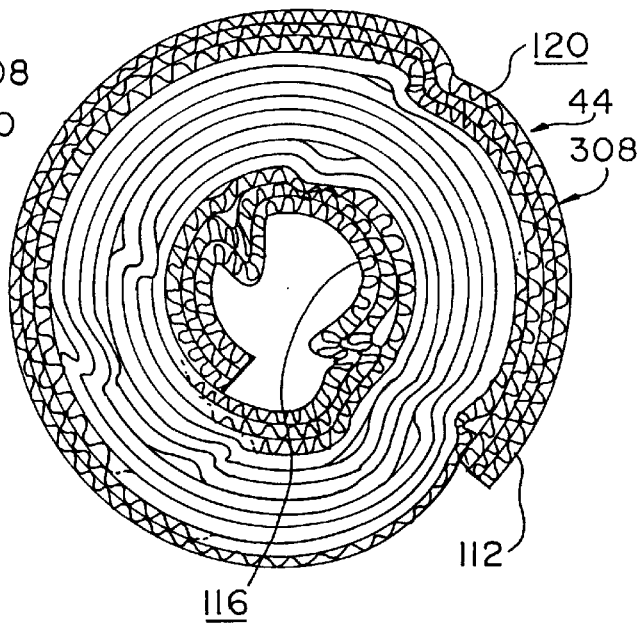
FIG. 27 is a top plan view of the vent of FIG. 26.

Alternatively, a roll 304, as depicted in FIG. 24, may be formed by rolling vent 44 in a direction generally parallel to longitudinal axis 92, such that top panel 110 is exposed on the exterior thereof. As shown in FIGS. 26–27, roll 308 may be formed by rolling vent 44, which has been formed by severing all or part of panels 160–162 in the manner described above. Roll 308 is formed by rolling the resulting vent 44 in a direction generally parallel to longitudinal axis 92. Roll 308 broadly includes rolls in which either lateral vents 112 or top panel 110 are radially exposed. However, roll 308 provides a less satisfactory appearance and utility than other embodiments described herein. Not being hingably joined, vent panels 160–162 tend to buckle and kink as roll 308 is formed. Thus, when unrolled on roof 40, a vent 44, which is rolled in roll 308, must be smoothed out prior to installation. The necessary smoothing activities require additional time and effort during the installation process.

Figure 25:
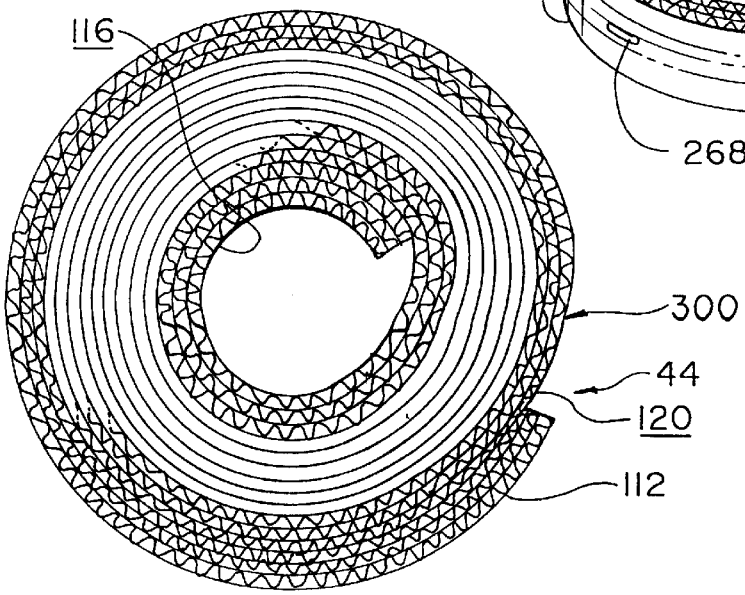
FIG. 25 is top plan view of the vent of FIG. 23.

By contrast, FIGS. 23-25 depict rolls 300, 304 as minimizing or eliminating the buckling and kinking present in roll 308. However, when rolled out prior to being installed, top panel 110 of roll 304 tends to arc upwardly between fasteners 268, as depicted in FIG. 29. Thus, roll 304, while more satisfactory than roll 308, nevertheless requires time to smooth out and conform against roof 40. By contrast, roll 300 rolls out smoothly and thus requires no additional time for installation, as shown in FIG. 28 and as further discussed below.

During shipping, the panels on the exterior of rolls 300, 304, and 308 may be subjected to scrapes, lacerations or punctures. In roll 304, top panel 110 is positioned at the outer circumference of the roll and is subject to damage. Clearly, when roll 304 is installed on a roof, a damaged top panel 110 may not protect the roof against infiltration by precipitation. However, in roll 300, top panel 110 is disposed radially interior to vent panels 160–162. This has many beneficial effects. One such effect is that panel 110 is more protected from damage during shipping. Other benefits are further discussed below.

It is believed that rolls 300 and 304 minimize kinking, in part due to utilizing means for hingably connecting adjacent panels 110, 160–162, such as the Z-folding technique disclosed herein. Rolls 300, 304, 308 are formed by rolling vent 44 into a spiral. Once formed into a spiral, adjacent layered panels 110, 160–162 are subjected to differing tensions. Those panels located more radially outward are subjected to different tensions than adjacent panels disposed more radially inward. This tension difference established in adjacent panels may produce undesired results.

In roll 308, top panel 110 and vent panels 160–162 are not hingably joined and are fastened together only with staples or equivalent fasteners. Because only staples or other fasteners are present, panels are free to kink or reposition between these fasteners along a longitudinal axis. This problem is more acute as more panels are used in a manner which allows relative self positioning of panels when subjected to roll-type tensioning. However, vent panels 110, 160–162 in rolls 300 and 304 are Z-folded (or otherwise hingably joined). Therefore, in rolls 300, 304, panels 110, 160–162 cannot slip, kink or reposition as readily as in roll 308. This facilitates a more uniform and efficient spiral roll.

Also, radially exterior panels in rolls 300, 304 will tend to stretch to a greater extent than radially interior adjacent panels. Accordingly, when top panel 110 is disposed radially inward to adjacent vent panels 160–162, exterior panels 162-160 tend to stretch in relation to their distance from adjacent panel 110. However, top panel 110 does not arc or buckle when roll 300 is unrolled. Thus, top panel 110 is further enhanced in its desirability due to improved smoothness and efficiency/ease of installation.

Figure 2:
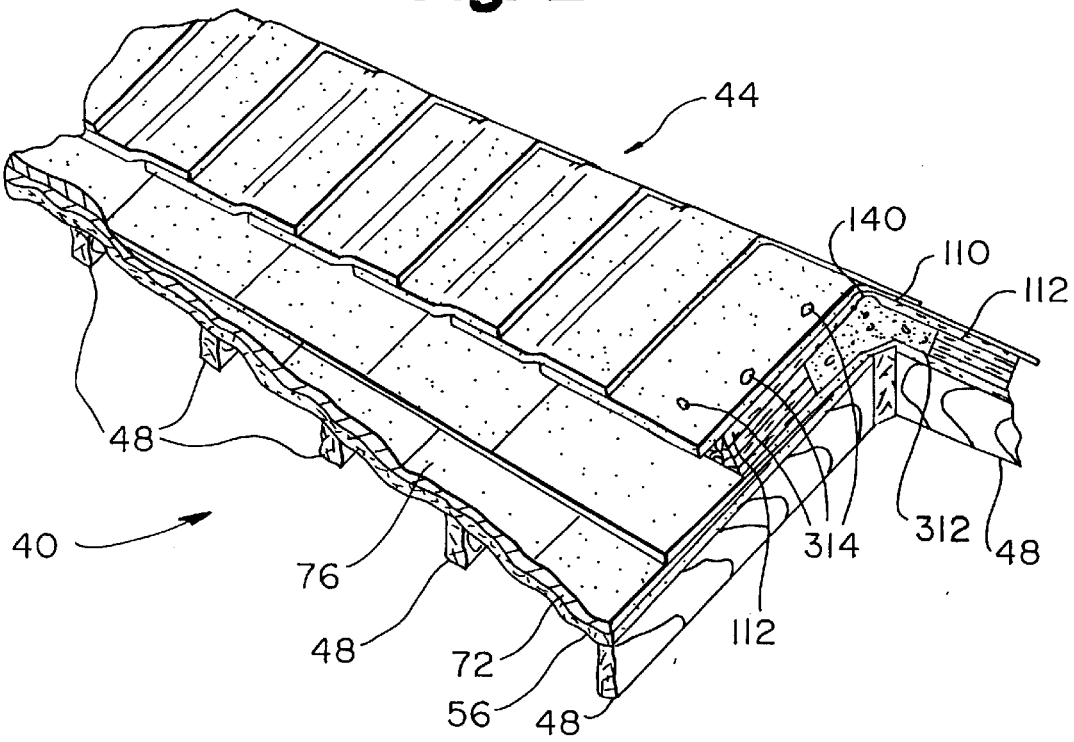
FIG. 2 is a fragmentary elevated perspective view of the ridge vent of FIG. 1 installed on the roof.
Figure 15:
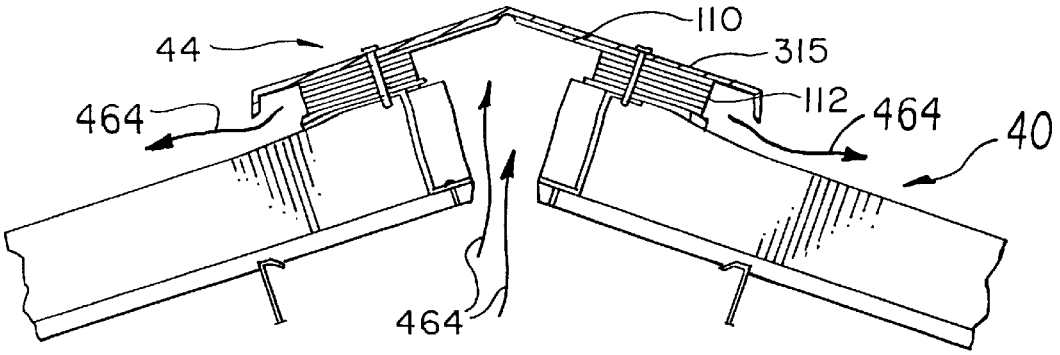
FIG. 15 is a fragmentary side sectional view of the vent of FIG. 1 installed on a metal roof and on which a metal roof cap has been installed.

FIG. 1 shows roll 300 being installed on roof 40 by being unrolled generally parallel to ridge 60. Either the entire length of roll 300 is unrolled or some desired amount thereof. After being unrolled from roll 300, vent 44 is conformed to roof 40 by being bent longitudinally along route 140. Lateral vents 112 are situated outboard (or outside) each cutout 68. Finally, end cap 312 may be disposed between top panel 110 and an underlying portion of roof 40 at ends 96, 100. End caps 312 may also be disposed at intermediate distances under top panel 110 as vent 44 is being installed. FIG. 2 shows fasteners 314 such as nails extended through top panel 110 and end cap 312. Other suitable fasteners may include staples and adhesives known to the art. End cap 312 may also be coated with a caulking material prior to being installed to better provide a seal and also to function as a fastener. Roofing materials 76, such as asphalt shingles, may be installed over vent 44. Finally, fasteners 314 such as nails are also extended through roofing materials 76, top panel 110, and lateral vents 112 into sheathing 56. A desirable feature of any of the vents of the present invention is that they may be installed by a nail gun without collapsing. Thus, their venting capacity is not diminished when a nail gun is used for installation, due to the resiliency thereof. Alternatively, as depicted in FIG. 15, vent or ridge caps 315 may be placed over installed ridge vent 44.

A series of colors may be utilized to encode various dimensions and embodiments of vent 44. For example, black might indicate a roll 44 nine inches wide, twenty feet in length and with three panels 160–162, while green might indicate the same panel design, but with a width of 11-¼ inches.

Once installed, ridge vent 44 advantageously allows for air exchange between an interior portion of roof 40 and the ambient exterior thereof. Each air passage 144, defined within vent 44, thus allows air to generally flow from inside to the exterior of roof 40. Moreover, virtually each element (top panel 110, vent panels 160–162) defines a multiplicity of air passages 144, each air passage 144 providing a conduit for air exchange.

Figure 17:
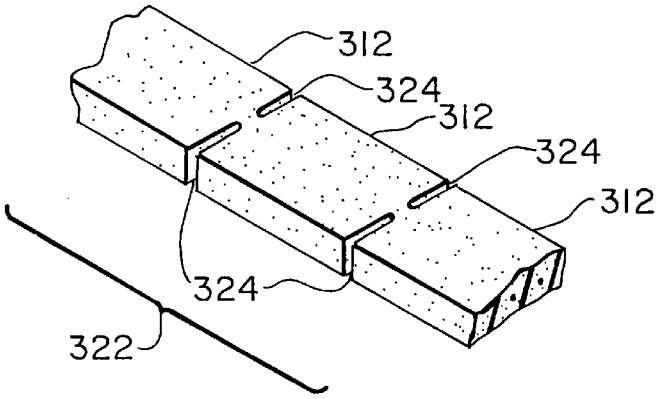
FIG. 17 is a fragmentary elevated perspective view of a foam block with notches defining end caps of the present invention.

End caps 312 may be formed separately for installation as herein described. FIG. 17 depicts a continuous and generally rectangular or parallelepiped block of foam 322. End caps 312 may be formed by defining notches 324 therein. End caps 312 may be prepared for use in installation by being severed from block 322 along notches 324. However, precut end caps 312 may be formed directly, eliminating the need to sever individual end caps 312 from block 322. End caps 312 and block 322 may be made from a moderate-density, closed-cell foam such as that sold by Dow as Ethyfoam™ polyethylene or from a polyurethane foam. End cap 312 has a length generally equal or slightly longer than gap 196. End cap 312 has a height and thickness generally equal or slightly greater than the height of lateral vents 112.

Figure 16:
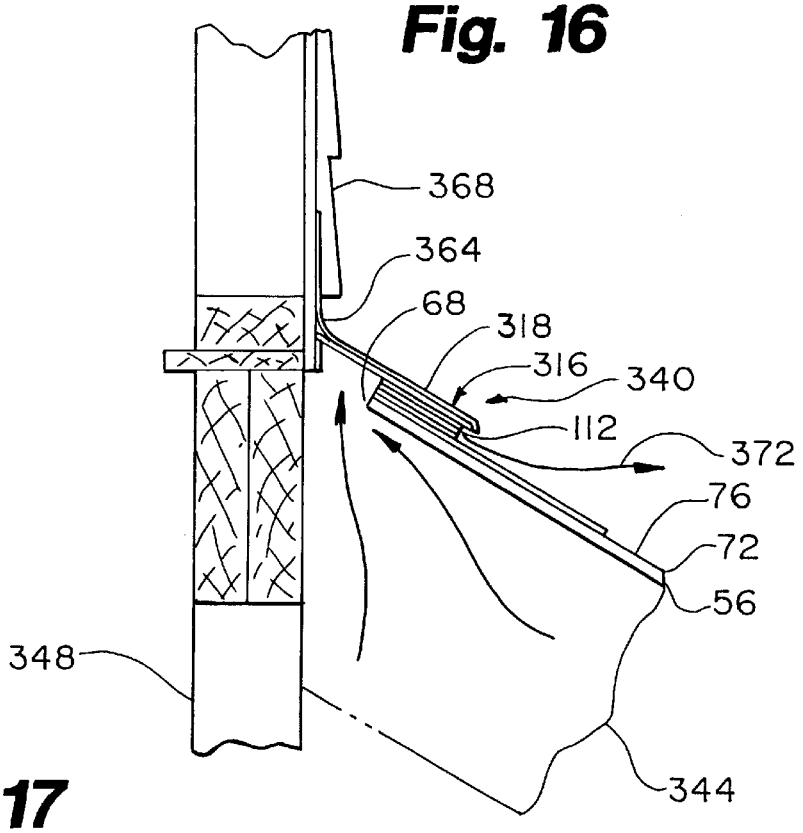
FIG. 16 is a fragmentary side sectional view of a shed roof, on which another embodiment of the present invention has been installed.

While satisfactory for portions of roofs with ridge lines, another embodiment of the present invention, as shown in FIG. 16, may be utilized for other types of roof conformations. Vent 316 may be formed by longitudinally severing one lateral vent 112 and an attached portion of top panel 110 from the remainder of vent 44.

Arcuate route 140 may be included within top panel 318 of vent 316. Alternatively, vent 316 may be prepared generally as described hereinabove, excluding one of lateral vents 112 and a corresponding portion of top panel 110. Once formed, vent 316 may be used on portions of roofs including those depicted hereinbelow.

FIG. 16 shows shed or clerestory roof 340 as including a series of rafters 344 secured against sidewall 348. Disposed atop rafters 344 is sheathing 56. Cutout 68 has been cut from sheathing 56 adjacent sidewall 348. Also present and overlaying sheathing 56 may be a layer of felt paper 72. Overlaying felt paper 72 is a roofing material 76 such as asphalt shingles. As installed on shed roof 340, vent 316 includes lateral vent 112 disposed outboard cutout 68. Top panel 318 spans cutout 68, is folded downwardly, and is typically secured to sidewall 348. Alternatively, a portion of top panel 318 may be folded upwardly and secured to wall 348. Lateral vent 112 and attached top panel 318 are then affixed to sheathing 56 by fasteners such as nails or adhesives. Flashing 364 is then installed over a portion of top panel 318 and adjacent side wall 348. Flashing 364 is further attached to side wall 348 above vent 316. Siding 368 extends over an upper portion of flashing 364. Roofing 76, such as asphalt shingles, or other protective devices may be placed over installed vent 316. As shown by arrows 372, air flow is thus enhanced from the interior to the exterior of shed roof 340 by installed vent 316.

Figure 13:
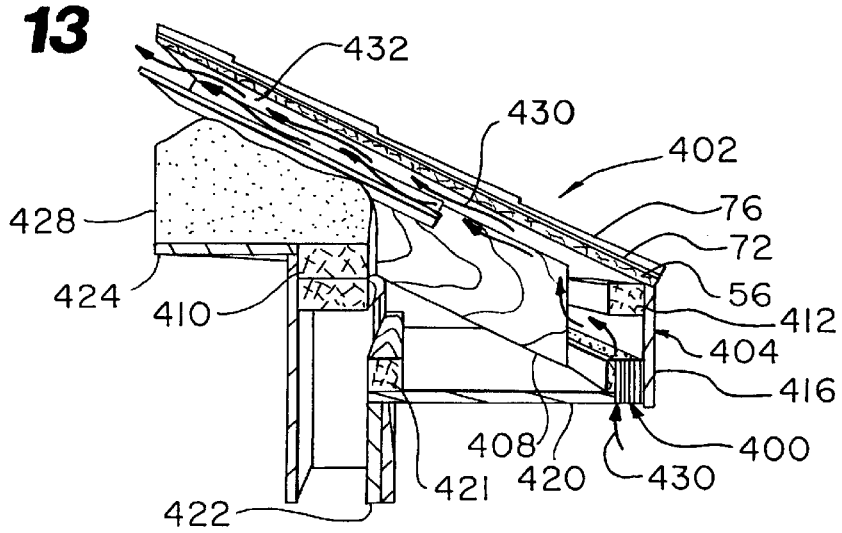
FIG. 13 is a fragmentary side sectional view of a vent of the present invention installed proximate a soffit.
Figure 14:
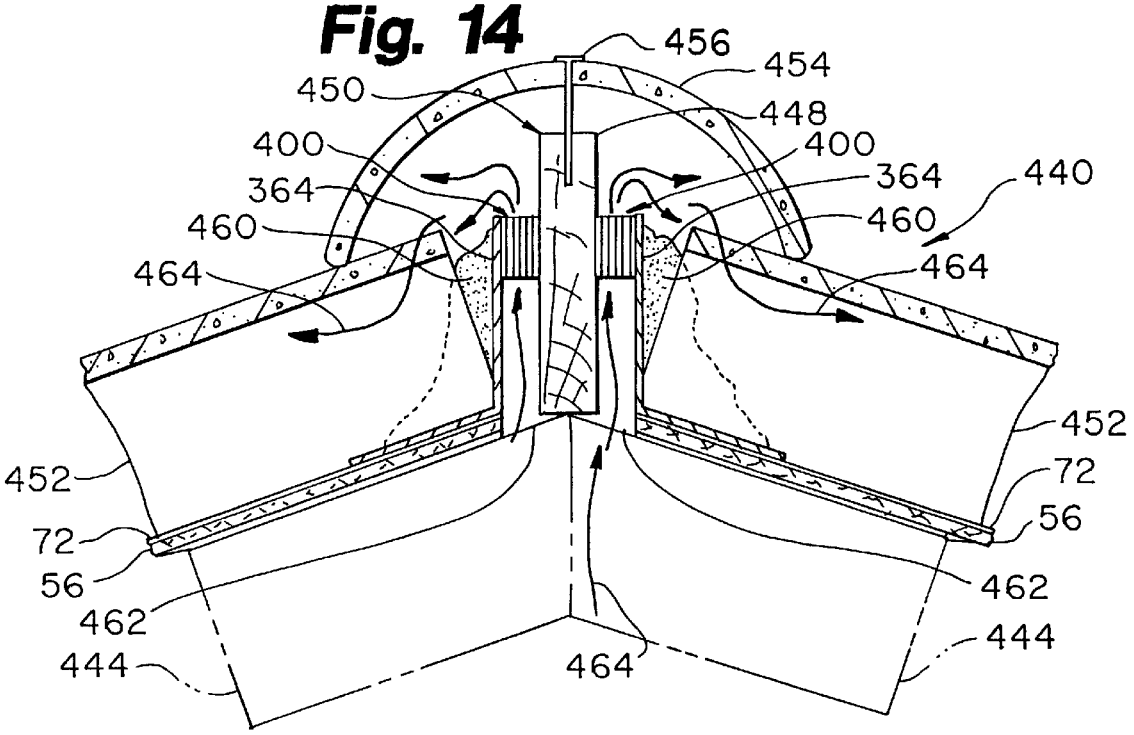
FIG. 14 is a fragmentary side sectional view of the vent of FIG. 13 installed in a roof on which S-tiles are present.

As depicted in FIGS. 13, 14, vent 400 may also be formed within the present invention. Vent 400 includes one or more vent panels 160–162. Vent panels 160–162 may be joined by any of the methods described hereinabove. Vent 400 may be further rolled, also as described above. Vent 400 may also be formed from the remainder of vent 44 when vent 316 is formed therefrom. One advantageous use of vent 400 is to further enable air exchange in a roof 402 by providing for air entry proximate a projecting portion 404 of a roof.

As shown by FIG. 13, exemplary projecting portion 404 broadly includes a bottom portion of rafter 408, which extends outboard and below top plate 410. At the outboard end of rafter 408 is spacer 412. Spacer 412 is sized to be the thickness of vent 400. Disposed outboard spacer 412 and vent 400 is facia board 416. Affixed atop rafter 408 is sheathing 56. Atop sheathing 56 are layers of felt paper 72 and roofing 76, respectively. Soffit 420 extends between vent 400 and side wall 422. Soffit 420 is affixed to a nailer 421, proximate side wall 422 and to an underside of rafter 408. Extending inboard from top plate 410 is ceiling 424. Disposed above ceiling 424 is insulation 428. As seen by arrows 430, airflow proceeds through vent 400 and air passageway 432 into the interior of roof 402.

FIG. 14 shows exemplary roof 440, which employs S-tiles as roofing materials. In roof 440, opposing rafters 444 are joined at an apex and cooperate with ridge board 448 to form peak 450. Disposed above rafters 444 are sheathing 56 and a layer of felt paper 72. Further disposed thereupon are S-tiles 452. Tile cap 454 is secured atop S-tiles 452 and over ridge board 448 by means of fastener 456. In this embodiment, the enhanced ventilation of roof 440 is accomplished by installing a vent 400 proximate each outboard side of ridge board 448. Flashing 364 is then affixed outboard each vent 440. Flashing 364 is further secured to decking 56. Finally, a layer 460 of plaster, cement or mortar is applied over flashing 364. Thus, air passageway 462, as depicted by air flow arrows 464, is formed. Hence, airflow from the interior of roof 440 proceeds through air passageway 462, through vent 400, beneath tile cap 454, and out the gaps between S-tiles 452.

Many desirable dimensions exist for vents 44, 316 and for panel 110 when used as a vent. However, vent 44 has been shown to conveniently conform to roofs when used in widths of 7, 9, and 11.25 inches (±0.25 inches), although other sizes may be suitable. Lateral vents 112 may be used in widths of 2 and 3 inches (±0.25 inches). The number of vent panels comprising lateral vents 112 may be altered as well. Vents 112 with 3 and 5 vent panels have shown satisfactory utility. Widths of panel 110 should generally conform to those of vents 44, 316. Vent 400 dimensions would be expected to be 1.5, 2, or 3 inches (±0.25 inches).

Figure 18:
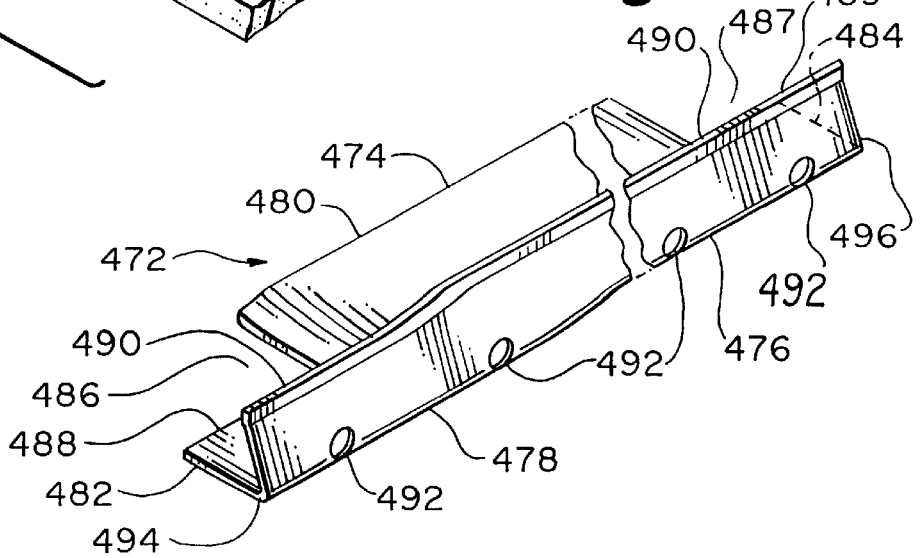
FIG. 18 is a fragmentary elevated perspective view of a wind deflector of the present invention.

As seen in FIGS. 18≧20, exemplary air or wind deflector 472 is optionally installed with vents 44, 316. Wind deflector 472 includes planar base member 474 and upright member 476. Base member 474 defines front edge 478, rear edge 480, and a pair of opposing end edges 482, 484. An opposing pair of notches 486, 487 is defined in base member 474 proximate the junction of rear edge 480 to each end edge 482, 484. Rear edges 488, 489 are respectively present on notches 486, 487. Upright member 476 terminates upwardly in lip 490. Upright member 476 further defines a plurality of generally circular apertures 492 proximate front edge 478. Wind deflector 472 may be made from 26-gauge sheet aluminum, stamped and folded to the configuration described hereinabove. Upright member 476 is joined to base member 474 at an angle of about 75° relative to the plane of base member 474. However, upright member 476 may be joined to base member 474 at angles of between about 65° and 85° as well. Lip 490 is joined to upright member 476 at a bend and angles from the plane of base member 474 at an angle between about 120° and 140°, for example at an angle of about 130°. A circular aperture 492 may be defined approximately two inches from each corresponding edge 494, 496. Additional apertures 492 may be spaced apart at approximately four-inch intervals. Each notch 486, 487 extends about two inches from corresponding end edges 482, 484. The length of exemplary wind deflector 472 is about 48 (±1) inches and its width is 2.625 (±0.25) inches. The height of wind deflector 472, as measured by upright member 476, is approximately 0.675 (±0.25) inches. The height of lip 490 is about 0.25 (±0.10) inches.

Figure 19:
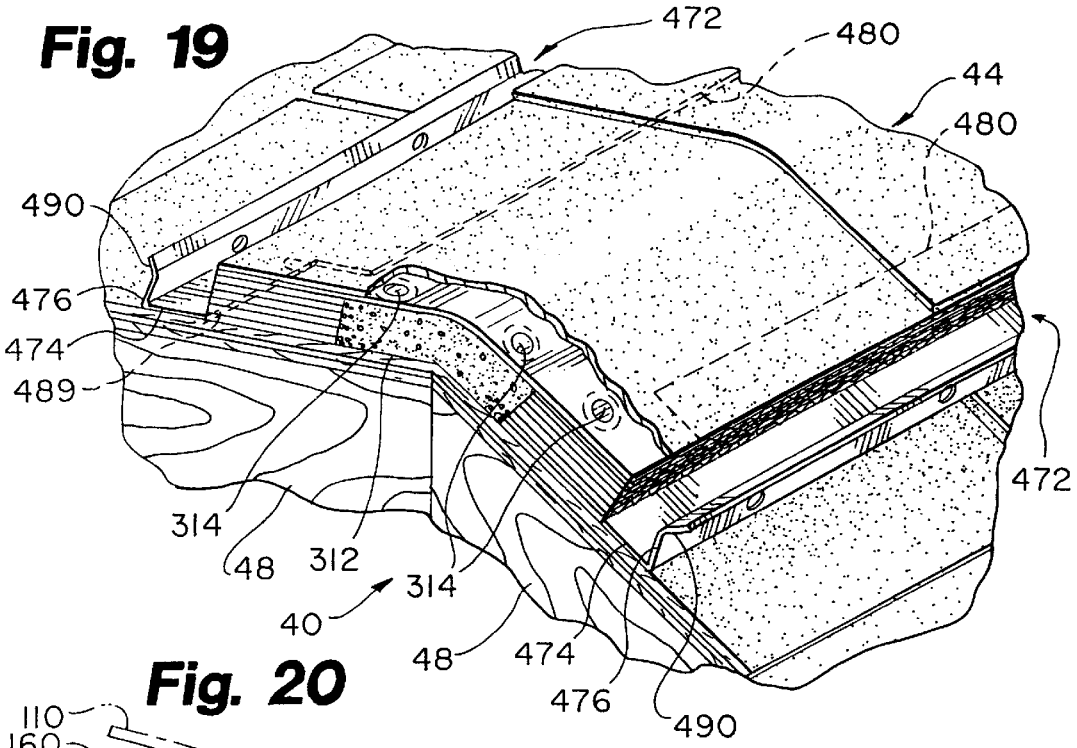
FIG. 19 is a fragmentary elevated perspective view of a ridge vent of the present invention installed on a roof with an end cap and a wind deflector installed thereto.
Figure 20:
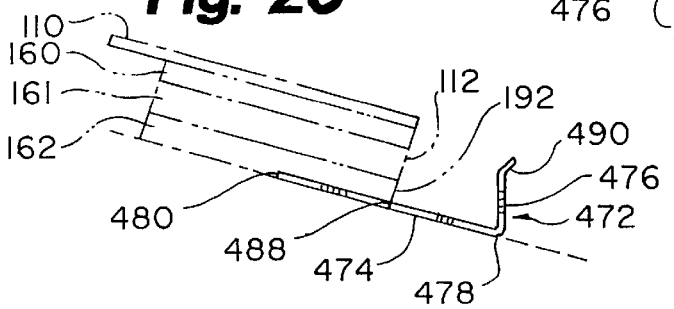
FIG. 20 is a fragmentary side plan view of the wind deflector of the present invention being installed on a roof in conjunction with a lateral vent and a portion of the top panel of the vent of FIG. 1 in phantom.

FIGS. 19, 20 illustrate that wind deflector 472 may also be emplaced as vent 44, 316 is being installed. However, wind deflector 472 may also be retrofitted to an installed roof ventilator. During installation, base member 474 is inserted beneath a panel such as panel 162. However, base member 474 may also be inserted between two other vent panels as well. Insertion proceeds until upright member 476 is disposed a specified distance away from an exterior edge of the vent part. Notches 486, 487 serve as guides for positioning and aligning wind deflector 472 with exterior edges of vent parts. Thus, base member 474 is slid under panel 162 until edges 488, 489 align with exterior edge 192. When wind deflector 472 is suitably positioned, fasteners 314, such as nails, are extended through overlaying roofing 76, vent parts 112, and base member 474 into decking 56.

Figure 30:
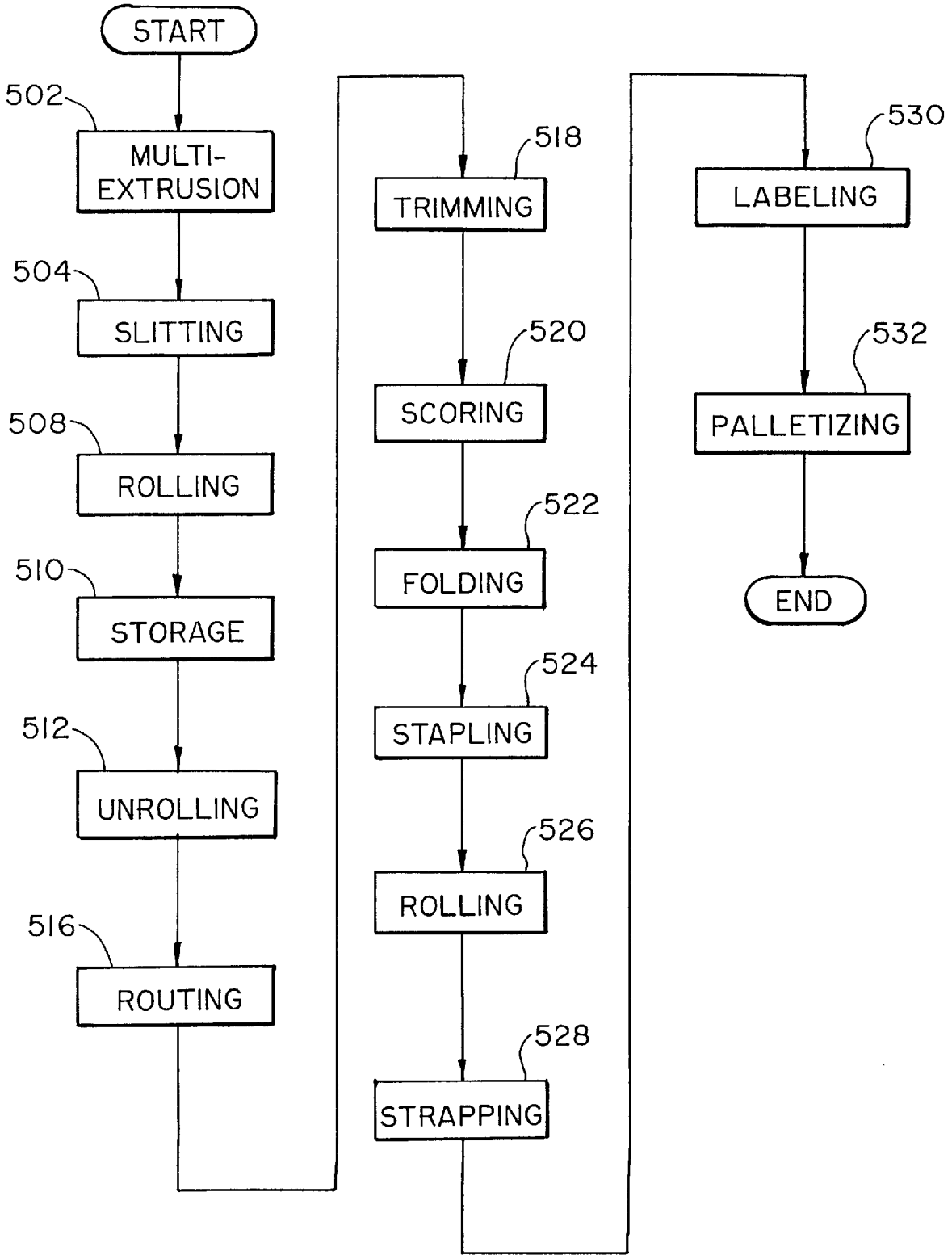
FIG. 30 is a flow chart depicting exemplary steps of making a ridge vent such as that depicted in FIG. 1.

FIG. 30 is a flow diagram depicting an exemplary method of forming vent 44. It is intended that the flow diagram depicted in FIG. 30 and the following explanation are provided by way of illustration and not limitation, since variations to this method sequence are contemplated as being within the spirit and scope of this invention. In step 502 weatherproof material 200 is formed by a multi-extrusion process known to the art. The multi-extrusion process of step 502 forms a continuous sheet. The continuous sheet of weatherproof material is then slit into desired widths in step 504, thereby forming continuous sheets of corrugated plastic such as the plastic described with respect to sheet 260. Exemplary rolls may be various widths, depending upon the number of panels and the widths of panels making up the final vent. The slits formed in step 504 preferably extend through layers 204, 208, 212 and are generally parallel to air passages 144. The continuous sheet may then be rolled about a mandrel in step 508, being cut when a sufficient length is wound thereon. The roll may then be stored in step 510 until needed for the remainder of the process. The stored rolls are then unrolled in step 512. While being unrolled in step 512, a route such as route 140 may be formed in step 516. After being routed, sheets 260 are further trimmed in step 518. Trimming step 518 assures that both lateral edges of sheets 260 are generally parallel and that top panel 110 and vent panels 160–162 will have the desired dimensions. Step 518 further enables top panel 110 and vent panels 160–162 to be defined such that they generally coextend as described hereinabove. Scores 264, 266 are then formed within trimmed sheets 260 in step 520, thereby defining top panel 110 and vent panels 160–162. Vent panels 160–162 are then folded proximate top panel 110 in an underlying relationship in step 522. Step 522 may involve methods for automatically folding vent panels 160–162 under top panel 110 in a continuous process. However, manually folding vent panels 160–162 in an underlying relationship is contemplated as well. Top panel 110 and vent panels 160–162 are then stapled together in step 524. Step 524 may further include manually or automatically emplacing staples at predetermined distances from each longitudinal end of formed vent 44. Step 524 may further include manually or automatically emplacing staples between about 1.5' and 2.5' apart. Step 524 may still further include manually or automatically emplacing staples about 2' apart. Formed and stapled vent 44 is then formed into spirals or rolls in step 526, for example, as shown in FIG. 24 or more preferably in FIG. 23. Spiral rolls formed in step 526 may be secured in step 528 by emplacing one or more bands therearound. Labels may be affixed to the strapped rolls in step 530. The labeled rolls may further be palletized for storage or shipment in step 532.

Numerous modifications may be made of this invention without departing from the spirit thereof. Therefore, the scope of the invention is not to be limited to the embodiments illustrated and described. Rather, the scope of the invention is to be determined by appended claims and their equivalents.

What is claimed is:

1. A venting device for a roof, comprising:

a first vent, the first vent including a first panel made from a weatherproof material, the weatherproof material with a first and a second ply joined such that a multiplicity of first air passages is defined, the first air passages with interior and exterior openings and extending generally transversely to a longitudinal axis of the venting device, the first vent conformable to a spiral by being rolled in a direction generally parallel to the longitudinal axis.

2. The weatherproof material of claim 1, further comprising a third ply joined to the second ply such that another multiplicity of first air passages is defined.

3. The weatherproof material of claim 1 or 2, in which the second ply is convoluted.

4. The weatherproof material of claim 2, in which the second ply includes a multiplicity of cross walls, the cross walls generally transverse to the first and second ply.

5. The venting device of any of claims 1, 2, or 4 in which the weatherproof material includes materials selected from the group consisting of polyethylene, corrugated paper, and a combination thereof.

6. The first vent of claim 1, in which a plurality of first panels is present, the first panels affixable to each other in a generally underlying relationship.

7. The first vent of claim 6, in which the first panels are generally coextensive.

8. The first vent of claim 6, in which at least one of the plurality of first panels comprises a third ply joined to the second ply such that another multiplicity of air passages is formed.

9. The first vent of claim 6 or 8, in which adjacent first panels are hingedly connected.

10. The first vent of claim 9, in which adjacent first panels are hingedly connected by a score line coextensive with each lateral edge of the first panels, the score lines extending through the second ply, the score lines further extending through the third plies of adjacent panel pairs proximate the interior lateral edges of the panel pairs and extending through the first plies of adjacent panel pairs proximate the exterior lateral edges of the panel pairs.

11. The first vent of claim 9, in which adjacent first panels are hingedly interconnected by a plurality of perforations coextensive with each lateral edge of the first panels, the perforations extending through each ply.

12. The first vent of claim 10, further comprising a fastener extending through each first panel.

13. The venting device of claim 6, further comprising a top panel, a multiplicity of air passages defined in the top panel by the weatherproof material, an exterior opening defined proximate each of a first and second lateral edge of the top panel for at least a portion of the top panel air passages, the first and top panel air passages generally parallel, an upper panel of the first vent affixable to the top panel in a generally underlying relationship, the top panel conformable to a place on the roof in which there is a change in the roof slope.

14. The venting device of claim 13, in which a longitudinal dimension of the top panel is generally equal to a longitudinal dimension of each first panel.

15. The venting device of claim 13, in which the first lateral edge of the top panel is generally aligned with an exterior first lateral edge of each first panel.

16. The top panel of claim 13, further comprising means for bending the top panel, thereby enabling the top panel to conform to a place on the roof where there is a change in the roof slope.

17. The top panel of claim 16, in which the bending means extends generally longitudinally.

18. The top panel of claim 16, in which the portion of the bending means is generally longitudinally coaxial to the top panel.

19. The top panel of claim 16, in which the bending means is defined by removing the second ply.

20. The top panel of claim 16, in which the top panel is made of the weatherproof material of claim 2 and in which the bending means is defined by removing the third ply and at least a portion of the second ply underlying the third ply.

21. The top panel of claim 20, in which the bending means is defined by a route.

22. The top panel of claim 21, in which the route is generally arcuate in cross section.

23. The venting device of claim 13, further comprising a second vent, a multiplicity of second air passages defined in the weatherproof material, the second air passages with interior and exterior openings and extending generally parallel to the first air passages, an upper panel of the second vent affixable to the top panel in a generally underlying relationship.

24. The second vent of claim 23, in which a plurality of second panels is present, the second panels affixable to each other in a generally underlying relationship.

25. The second vent of claim 24, in which the second panels are generally coextensive.

26. The venting device of claim 24, in which the longitudinal dimension of the top panel is generally coextensive to a longitudinal dimension of each second panel.

27. The venting device of claim 24, the weatherproof material further comprising a third ply joined the second ply such that another multiplicity of first air passages is defined, and wherein an upper second panel of the second vent i affixable to the top panel in a generally underlying relationship.

28. The venting device of claim 27, in which the exterior edges of the first and second vents are co-aligned with the respective first and second lateral edges of the top panel, the venting device in a spiral configuration.

29. The venting device of claim 27, the second vent further comprising a plurality of fasteners extending through each second vent panel and the top panel.

30. The venting device of claim 29, in which the fasteners are staples.

31. The venting device of claim 27, in which the venting device is rolled into a spiral configuration such that the vents extend radially outwardly from the top panel.

32. The venting device of claim 13 or 23, further comprising an end cap, the end cap conformable to an underside of the top panel and to a portion of the roof underlying the top panel, the end cap for preventing ingress of precipitation under the top panel when in place beneath an end of the top panel.

33. The end cap of claim 32, in which the end cap includes a moderate density closed-cell foam.

34. The end cap of claim 33, in which the foam is selected from the group consisting of polyethylene, polyurethane, or a combination thereof.

35. The venting device of claim 32, further comprising an end cap fastener, selected from the group consisting of a nail, a staple, an adhesive, a caulking compound, and any combination thereof.

36. The venting device of claim 13 or 23, further comprising an air deflector,the deflector comprising a first planar portion and a second planar portion, the first planar portion of the air deflector disposable beneath a lower surface of the venting device such that the second planar portion of the air deflector diverts ambient air flow and thereby inhibits ingress of precipitation into air passages proximate the second portion of the air deflector.

37. The venting device of claim 36, in which the air deflector is generally L-shaped in cross section.

38. The venting device of claim 36, in which the first and second planar portions are integrally joined at a bend.

39. The venting device of claim 38, in which the planar portions are joined at an acute angle.

40. The venting device of claim 39, in which the acute angle is between about 65° and 85°.

41. The venting device of claim 39, in which the acute angle is about 75°.

42. The venting device of claim 38, the second planar portion further including a unitary, terminal lip.

43. The venting device of claim 42, in which the terminal lip joins the second planar portion at an obtuse angle from a first planar portion plane.

44. The venting device of claim 42, in which the acute angle is between about 125° and 145°.

45. The venting device of claim 43, in which the obtuse angle is about 135°.

46. The venting device of claim 36, in which the second planar member defines a plurality of apertures.

47. The venting device of claim 36, the first planar member defining a notch, the notch extending inwardly from an edge opposite the bend.

48. The venting device of claim 3, in which the weatherproof material includes materials selected from the group consisting of polyethylene, corrugated paper, and a combination thereof.

49. A venting device for a roof, the venting device comprising a panel made from a weatherproof material, the weatherproof material with a first and second ply joined such that a multiplicity of generally parallel air passages is defined thereby, the air passages with interior openings and exterior openings defined by the weatherproof material, the air passages extending generally transversely to a longitudinal axis of the venting device, the venting device conformable to a spiral by being rolled in a direction generally parallel to the longitudinal axis, the venting device further conformable to the roof proximate a place on the roof where two portions of the roof with differing slopes are joined.

50. A venting device for a roof, comprising:

a top panel, made of a weatherproof plastic material, the weatherproof plastic material including two generally planar plies and a convoluted ply between the planar plies, each planar ply joined to the convoluted ply such that a multiplicity of top panel air passages are defined thereby, the top panel air passages extending generally transversely to a longitudinal axis of the top panel, the top panel with first and second lateral edges, each air passage with an exterior opening defined by the weatherproof plastic material at one of the lateral edges, the top panel divided into two sections, the top panel further including an area between the two sections, the area between the two sections defined by a route on an underside of the top panel and in which one of the planar plies and at least a portion of the convoluted ply are removed, the route generally and longitudinally coaxial to a the top panel and defining an interior opening for at least a portion of the top panel air passages;

a first and a second vent, each vent including a plurality of panels made from a weatherproof plastic material, the weatherproof plastic material including two generally planar plies and a convoluted ply between the planar plies, each planar ply joined to the convoluted ply such that a multiplicity of first and second air passages are defined in the respective first and second vents, the first and second air passages generally parallel to the top panel air passages, each panel in the first and second vents with an internal and an external edge, each first and second air passage with respective internal and external openings defined at the internal and external edges of the panels, the panels of each vent generally underlying each other, an upper panel of each vent in underlying relation to a lower surface of the top panel, the panels of each vent hingedly interconnected, the upper panel of each vent hingedly connected to the top panel, the panels of each vent further connected to the top panel by a fastener, the ventilating device conformable to spiral by being rolled in a direction generally parallel to a longitudinal axis of the ventilating device.

51. The ventilating device of claim 50, in which the ventilating device is in a spiral conformation.

52. The ventilating device of claim 51, in which the first and second vents extend radially outward from the attached top panel.

53. A ridge vent for placement on a roof, comprising:

a top panel having a longitudinal axis, first and second ends, first and second side edges, and an outer and an inner surface; and vent means attached to a corresponding portion of the top panel inner surface, the vent means comprising a multiplicity of air passages, the vent means defining an interior opening and an exterior opening for a portion of the air passages, the ridge vent being assembled to form a first rolled configuration for shipment and a second unrolled configuration for placement on a roof, the first rolled configuration having the vent means protruding a greater radial distance from a center of the rolled ridge vent than any top panel portion attached to the corresponding vent means.

54. A method of making a device for ventilating a roof, the method comprising the steps of:

providing a weatherproof material with a first and a second ply joined such that a multiplicity of first air passages is defined thereby;

defining a first panel in the weatherproof material;

defining interior openings in at least a portion of the multiplicity of first air passages, the first air passages extending generally transversely to a longitudinal axis of the first panel; and conforming the first panel into a spiral by rolling the first panel in a direction generally parallel to the first panel longitudinal axis.

55. The method of claim 54, in which the step of defining interior openings includes defining a route.

56. The method of claim 55, in which the step of defining interior openings includes defining the route such that the route is generally arcuate in cross section.

57. The method of claim 55, in which the step of defining interior openings includes defining the route such that the route generally coextends with the first panel longitudinal axis.

58. The method of claim 54, further comprising the step of defining a second panel from the weatherproof material and in which the conforming step includes rolling the first and second panels together.

59. The method of claim 58, in which the second panel is defined such that a longitudinal dimension of the first panel is generally equal to a longitudinal dimension of the second panel.

60. The method of claim 58, in which the step of defining a second panel includes perforating the first and second plies.

61. The method of claim 58, further comprising the step of disposing the first panel proximate the second panel in a generally underlying relationship.

62. The method of claim 61, in which the first and second panels are disposed so that a lateral edge of the first panel aligns generally vertically with an exterior edge of the second panel.

63. The method of claim 61, in which the first and second panels are disposed so that a first end of the first panel aligns generally vertically with a first end of the second panel.

64. The method of claim 61, in which the step of disposing the first vent proximate the second vent includes extending a fastener through the first and second panels.

65. The method of claim 58, the weatherproof material further including a third ply joined to the second ply such that another multiplicity of first air passages is defined thereby.

66. The method of claim 65, in which the second panel is defined by extending a slit through the first and second plies.

67. The method of claim 58, in which the first and second panel are conformed into the spiral such that the first panel is a first radial distance from a center of the spiral, the second panel is a second radial distance from the center of the spiral, and such that the first radial distance is less than the second radial distance.

68. A method of making a device for ventilating a roof, comprising the steps of:

providing a weatherproof material with a first ply and a second ply, the first and second ply joined such that a multiplicity of air passages is defined thereby;

defining a first panel in the weatherproof material such that the air passages extend generally transversely to a first panel longitudinal axis; and conforming the first panel into a spiral configuration by rolling the first panel in a direction generally parallel to the first panel longitudinal axis.

69. The method of claim 68, further comprising the step of defining a second panel from the weatherproof material such that the air passages extend generally transversely to a second panel longitudinal axis and in which conforming the first panel into a spiral configuration includes conforming the second panel into the spiral configuration with the first panel.

70. The method of claim 68, in which defining the first and second panels includes perforating the first and second plies.

71. The method claim 68, in which the weatherproof material includes a third ply joined to the second ply such that another multiplicity of air passages is defined thereby and in which the first and second panels are defined by extending a slit through the first and second plies.

72. The method of claim 68, further comprising the step of extending a fastener through the first and second panels.

73. The method of claim 72, in which staples are extended through the first and second panels.

74. A method of installing a venting device on a roof with a slot defined by a sheathing layer, the method comprising the steps of:

providing a vent assembly, the vent assembly including a first panel made from a weatherproof material, the weatherproof material with a first and a second ply joined such that a multiplicity of air passages is defined thereby, the air passages extending generally transverse to a longitudinal axis of the first panel, the vent assembly conformed into a spiral by rolling the first panel in a direction generally parallel to the first panel longitudinal axis;

unrolling the vent assembly; and affixing the vent assembly to the roof.

75. The method of claim 74, in which a vent assembly including a second panel is provided, the second panel proximate the first panel in a generally underlying relationship, in which the second panel and the first panel are conformed into a spiral, in which the second panel is radially exposed in the spiral and further including the step of disposing the second vent proximate the slot.

76. The method of claim 75, in which a vent assembly including a third panel is provided, the third panel opposing the second panel and proximate the first panel in a generally underlying relationship, in which the first, second, and third panels are conformed into a spiral, and in which the second and third panels are radially exposed in the spiral.

77. A method of installing a venting device in the eave of a roof, comprising the steps of:

providing the venting device, the venting device including a first panel made of a weatherproof material including a first and a second ply joined such that a multiplicity of air passages is defined thereby, the air passages extending generally transversely to a longitudinal axis of the venting device, the venting device conformed in a spiral conformation by rolling the venting device in a direction generally parallel to the longitudinal axis; and affixing the venting device proximate the eave.

78. The method of claim 77, in which the venting device provided includes a plurality of panels disposed in a generally underlying relationship.

79. The method of claim 78, in which the venting device provided is made of a weatherproof material including first, second, and third plies, the first and third plies joined to the second ply such that another multiplicity of air passages is defined thereby.

80. A process of forming a vent for a roof from a weatherproof material with a fluted layer disposed between first and second generally planar layers such that a multiplicity of generally parallel air passages is formed thereby, the process comprising the steps of:

providing a sheet of the weatherproof material, the sheet having a longitudinal axis generally transverse the air passages;

forming a pair of first lateral slits, the longitudinal axis generally disposed between the first lateral slits, each first lateral slit extending through the second planar layer and at least partially through the fluted layer, thereby defining a top panel and two laterally disposed side panels;

folding each side panel in an underlying relationship to the top panel by automatic folding means;

securing each folded side panel to the top panel by automatic securing means, thereby forming a vent; and conforming the vent into a spiral configuration by rolling the vent along the longitudinal axis.

81. The process of claim 80, further comprising the step of forming a route at least partially through the first planar and fluted layers, the route extending generally across the air passages.

82. The process of claim 80, in which the route is formed such that it generally coextends with the longitudinal axis.

83. The process of claim 80, in which each folded side panel is automatically secured to the top panel by extending a fastener thereinto.

84. The process of claim 83, in which each folded side panel is automatically secured with a staple.

85. The process of claim 83, in which each folded side panel is automatically secured with a plurality of fasteners, each fastener being spaced at a predetermined distance.

86. The process of claim 85, in which a first pair of fasteners is present, each fastener being a predetermined distance from each end of the vent.

87. The process of claim 86, in which a second pair of fasteners is disposed between the first pair of fasteners, the second pair of fasteners being disposed between about 1.5 feet and 2.5 feet apart.

88. The process of claim 86, in which a second pair of fasteners is disposed between the first pair of fasteners, the second pair of fasteners being disposed about 2 feet apart.

89. The process of claim 87, in which the fasteners are staples.

90. The process of claim 80, further comprising the step of trimming each lateral edge of the sheet such that each trimmed lateral edge is generally parallel the longitudinal axis.

91. The process of claim 80, in which the provided sheet is formed by multi-extruding the fluted and planar layers.

92. The process of claim 91, in which the provided sheet is formed by extending a slit along a predetermined distance, the slit being generally transverse the air passages.

93. The process of claim 92, in which the provided sheet is formed by conforming the sheet to a spiral.

94. The process of claim 80, in which a pair of first lateral slits and a pair of second lateral slits are formed, the longitudinal axis being disposed between the first lateral slits, the first lateral slits being disposed between the second lateral slits, each first and second lateral slit being generally parallel to the longitudinal axis, each first lateral slit extending through the second planar ply and through at least a portion of the fluted ply, each second lateral slit being through the first planar ply and through at least a portion of the fluted ply, thereby defining a top panel and two pairs of laterally disposed side panels, in which the side panels are folded in an underlying relationship to the top panel by said automatic folding means, and in which each folded side panel is secured to the top panel by said automatic securing means, thereby forming the vent.

* * * * *